US008758074B2

(12) United States Patent
Dilworth et al.

(10) Patent No.: US 8,758,074 B2
(45) Date of Patent: Jun. 24, 2014

(54) BODY-CARRIED OR WORN MECHANICAL REMOTELY-CONTROLLED AMUSEMENT DEVICE, COSTUME OR ACCESSORY

(75) Inventors: Peter Dilworth, Somerville, MA (US); Max Bogue, Wellesley, MA (US)

(73) Assignee: Wobbleworks, Inc., Wilmington, DE (US)

( * ) Notice: Subject to any disclaimer, the term of this patent is extended or adjusted under 35 U.S.C. 154(b) by 635 days.

(21) Appl. No.: 12/976,521

(22) Filed: Dec. 22, 2010

(65) Prior Publication Data

US 2012/0164910 A1 Jun. 28, 2012

(51) Int. Cl.
*A63H 33/00* (2006.01)

(52) U.S. Cl.
USPC ..... 446/26

(58) Field of Classification Search
CPC ..... A63H 33/00; A63H 37/00; A63J 7/005; A42B 1/004
USPC ..... 446/26–28; 472/70; 2/209.11, 209.13
See application file for complete search history.

(56) References Cited

U.S. PATENT DOCUMENTS

| | | | | | |
|---|---|---|---|---|---|
| 560,418 | A | * | 5/1896 | Lorenz | 446/27 |
| 1,324,218 | A | * | 12/1919 | Ward | 472/70 |
| 1,618,517 | A | * | 2/1927 | Cureton | 446/27 |
| 2,018,062 | A | * | 10/1935 | Hardt | 280/810 |
| 2,497,493 | A | * | 2/1950 | Theodore | 623/24 |
| 3,705,466 | A | * | 12/1972 | Sela | 446/27 |
| 4,007,646 | A | * | 2/1977 | De Jonge | 74/501.6 |
| 4,268,918 | A | * | 5/1981 | Lee | 2/172 |
| 4,447,250 | A | * | 5/1984 | Wotens et al. | 446/27 |
| 4,658,446 | A | * | 4/1987 | McGill | 2/209.13 |
| 4,787,100 | A | | 11/1988 | Jonat | 2/80 |
| 4,832,647 | A | * | 5/1989 | Perlman | 446/27 |
| 4,909,769 | A | * | 3/1990 | Paterson | 446/28 |
| 5,306,199 | A | * | 4/1994 | Locricchio | 446/177 |
| 5,372,549 | A | * | 12/1994 | Piedmont | 472/54 |
| 6,135,846 | A | * | 10/2000 | Young | 446/302 |
| 6,315,571 | B1 | | 11/2001 | Lee | 434/250 |
| 6,500,041 | B1 | * | 12/2002 | Crome, Jr. | 446/27 |
| 8,087,969 | B2 | * | 1/2012 | Sun et al. | 446/28 |
| 2006/0183402 | A1 | * | 8/2006 | von Jabba | 446/359 |
| 2009/0280715 | A1 | * | 11/2009 | Palmeiri | 446/28 |

OTHER PUBLICATIONS

Brannon, Patrick J., et al., "The effects of mold filling on living hinge performance", ANTEC 2000 Conference Proceedings, vol. III, 5 pages, May 7-11, 2000.

(Continued)

*Primary Examiner* — Gene Kim
*Assistant Examiner* — Alyssa Hylinski
(74) *Attorney, Agent, or Firm* — Sunstein Kann Murphy & Timbers LLP

(57) ABSTRACT

Body-carried or worn, mechanically remotely-controlled novelty devices include one or more articulated members, each in the shape of a whimsical or anatomical feature, that may be covertly actuated by bending a digit, writs, etc. of a human wearer. The articulated member(s) may be attached to a headband, belt, slipper, shoulder strap or the like. A hinged, pivoted or bendable portion of each articulated member may be coupled by a Bowden cable extending down the user's sleeve to an actuator, such as a ring, lever or key, proximate the user's hand. Actuator levers may be installed in slippers, or the like, and coupled to articulated members having shapes, such as mouths or extended toe portions of the slippers, to animate the articulated members. In elaborate embodiments, each finger or toe may actuate a different portion of an articulated member or a distinct articulated member.

20 Claims, 17 Drawing Sheets

(56) References Cited

OTHER PUBLICATIONS

Rees, Herbert, Mold Engineering Second Edition, ISBN 1-56990-322-0, pp. 135-136, 2002.
Act One Costume novelty hats web page, http://www.actonecostumes.net/noveltyhats.html, 2 pages, Dec. 7, 2010.
Monty Python Killer Rabbit Slippers, BunnySlippers.com web page, http://www.bunnyslippers.com/bunny-slippers/killer-rabbit-slippers.php, 1 page, Dec. 15, 2010.
Tom Worsnopp, Hand Masters Reference Page, http://lims.mech.northwestern.edu/projects/finger_exo/, 8 pages, Dec. 20, 2010.

* cited by examiner

BODY-CARRIED OR WORN MECHANICAL REMOTELY-CONTROLLED AMUSEMENT DEVICE, COSTUME OR ACCESSORY

TECHNICAL FIELD

The present invention relates to devices for the amusement or recreation of human beings and, more particularly, to body-carried or worn amusement devices, portions of which may be animated by mechanical remote control by the carriers or wearers of the devices.

BACKGROUND ART

Static (i.e., non-animated) body-carried or worn amusements, such as a pair of "bunny ears" or "insect antennae" attached to a headband, are well known and appreciated for their amusement value as humorous gifts, costume accessories and the like. Similarly, slippers having portion shaped like mouths are well known. For example, Monty Python Killer Rabbit Slippers having rabbit faces with articulated mouths are available from ThinkGeek, Inc., 11216 Waples Mill Rd., Suite 100, Fairfax, Va. 22030. Some such devises include spring-mounted elements that wiggle in response to gross body movements by their wearers. Other such devices include actuator strings that, when pulled, cause movement of one or more elements. For example, a Flappy Cap—Flyin Pig Hat (model no. NHT120) available from Act One Costume, Putnam Valley, N.Y. 10579, includes a hat with wings that flap when a string descending next to a wearer's ear is pulled. U.S. Pat. No. 4,658,446 discloses a cap with movable animations that are actuated by pulling a pair of strings extending out the back of the cap.

However, actuating such devices requires overt action by the wearers. Some users would prefer novelty devices that can be covertly actuated or novelty devices capable of elaborate movements that would require coordinated actuation of more than a single pull cord.

SUMMARY OF EMBODIMENTS

An embodiment of the present invention provides a body-carried or body-worn, mechanically remotely-controlled novelty device. The novelty device includes an article of apparel that defines an opening. The article of apparel is configured to be removably attached to a portion of a human body, other than a hand, by receiving the portion of the human body within the opening. An articulated member is attached to the article of apparel. The articulated member includes a first portion and a second portion. The second portion is movable, relative to the first portion. An actuator is configured to receive a digit of the human body and to move in response to movement of the received digit. A link solely mechanically couples the actuator to the articulated member. Movement of the actuator, caused by movement of the received digit, causes movement of the second portion of the articulated member, relative to the first portion of the articulated member.

The actuator may define a shape-retaining portion configured to receive the digit of the human body. The actuator may include a ring or a lever sized to receive a human digit.

The actuator may include a housing sized and configured to fit within a palm of the human body. A spring-loaded plunger may extend from the housing. An end of the plunger may be configured to receive the digit. The plunger may be mechanically coupled to the link such that movement of the plunger causes the movement of the link.

The link may include a tube having a length and a cable extending coaxially through the tube. The movement of the actuator may cause translation of the cable along the length of, and relative to, the tube.

The novelty device may also include a reference position member that defines an opening. Such a reference position member may be configured to be removably attached to at least a portion of an appendage of the human body by receiving the at least a portion of the appendage within the opening. The tube may be attached to the position reference member. The position reference member may be or include a writs strap, a bracelet or at least a portion of a sleeve of a shirt.

The link may include a lever, and the cable may be attached to one end of the lever. The other end of the lever may be rigidly attached to the second portion of the articulated member. The translation of the cable may, therefore, cause movement of the lever, and the movement of the lever may cause the movement of the second portion of the articulated member through a mechanical advantage provided by the lever.

The articulated member may have an external shape. At least a portion of the external shape may represent a shape of an anatomical feature, a body part, an ear, an antenna, an antler, a horn, a tail, a mouth, a lip, a nose, an elephant trunk, an eye, an eyelid, a toe, a heart, a head, an arm, a leg, a wing, a hat, an elongated tapered portion, a narrow end of which terminates in a closed end, a whimsical shape or at least a portion of a cartoon character.

The article of apparel may be or include: a headband, a belt, a shoulder strap, a cap, an article of footwear, a shirt, a backpack, pants or a shirt having a hood.

The articulated member may include a hinge coupled between the first portion and the second portion of the articulated member. The articulated member may include a resilient portion coupled between the first portion and the second portion of the articulated member. The resilient portion may be configured to urge the second portion toward a predetermined orientation, relative to the first portion. The articulated member may include a spring coupled between the first portion and the second portion of the articulated member. The spring may be configured to urge the second portion toward a predetermined orientation, relative to the first portion. The articulated member may include a pivot coupled between the first portion and the second portion of the articulated member. The pivot may be configured to permit the second portion to rotate, relative to the first portion, at least about 10 degrees about the pivot.

The articulated member may include a bendable portion coupled between the first portion and the second portion of the articulated member. The bendable portion of the articulated member may be thinner than portions of the articulated member adjacent the bendable portion. In this case, the bendable portion may be more flexible than the adjacent portions.

Another embodiment of the present invention provides a body-carried or body-worn, mechanically remotely-controlled novelty device. The device includes an article of apparel that defines an opening. The article of apparel may be configured to be removably attached to a portion of a human body, other than a hand, by receiving the portion of the human body within the opening. An articulated member is attached to the article of apparel. The articulated member includes a first portion and a second portion. The second portion may be movable, relative to the first portion. An actuator may define a shape-retaining portion. The shape-retaining portion of the actuator may be configured to receive a digit of the human body and to move in response to movement of the received digit. A link solely mechanically couples the actuator to the articulated member. Movement of the actuator, caused by movement of the received digit, causes movement of the second portion of the articulated member, relative to the first portion of the articulated member.

Another embodiment of the present invention provides a body-carried or body-worn, mechanically remotely-controlled novelty device. The device includes an article of apparel that defines an opening. The article of apparel may be configured to be removably attached to a portion of a human body, other than a hand, by receiving the portion of the human body within the opening. An articulated member is attached to the article of apparel. The articulated member includes a first portion and a second portion. The second portion may be movable, relative to the first portion. An actuator may include a ring sized and configured to receive a digit of a human body. The actuator may be configured to move in response to movement of the received digit. A link solely mechanically couples the actuator to the articulated member. Movement of the actuator, caused by movement of the received digit, causes movement of the second portion of the articulated member, relative to the first portion of the articulated member.

Yet another embodiment of the present invention provides a body-carried or body-worn, mechanically remotely-controlled novelty device. An article of apparel defines an opening and is configured to be removably attached to a portion of a human body, other than a hand, by receiving the portion of the human body within the opening. An articulated member is attached to the article of apparel. The articulated member includes a first portion and a second portion. The second portion may be movable, relative to the first portion. An actuator may be configured to receive a digit of the human body and to move in response to movement of the received digit. A link solely mechanically couples the actuator to the articulated member. Movement of the actuator, caused by movement of the received digit, causes movement of the second portion of the articulated member, relative to the first portion of the articulated member. The actuator includes a housing sized and configured to fit within a palm of the human body. In addition, the actuator includes a spring-loaded plunger extending from the housing. An end of the plunger may be configured to receive the digit. The plunger may be mechanically coupled to the link, such that movement of the plunger causes the movement of the link.

An embodiment of the present invention provides a body-carried or body-worn, mechanically remotely-controlled novelty device. An article of apparel defines an opening and is configured to be removably attached to a portion of a human body, other than a hand, by receiving the portion of the human body within the opening. An articulated member is attached to the article of apparel. The articulated member includes a first portion and a second portion. The second portion may be movable, relative to the first portion. An actuator may be configured to receive a digit of the human body and to move in response to movement of the received digit. A link may include a tube and a cable extending coaxially through the tube. The cable may solely mechanically couple the actuator to the articulated member. Movement of at least a portion of the actuator, caused by movement of the received digit, causes movement of the second portion of the articulated member, relative to the first portion of the articulated member.

Optionally, the novelty device may include a reference position member. The reference position member defines an opening and is configured to be removably attached to at least a portion of an appendage of the human body by receiving the at least a portion of the appendage within the opening. At least a portion of the tube is attached to the position reference member.

Another embodiment of the present invention provides a body-carried or body-worn, mechanically remotely-controlled novelty device. An article of apparel defines an opening and is configured to be removably attached to a portion of a human body, other than a hand, by receiving the portion of the human body within the opening. At least two articulated members are attached to the article of apparel. Each articulated member includes a first portion and a second portion. Each second portion is movable, relative to the first portion. A separate actuator is associated with each of the articulated members. Each actuator is configured to receive a digit of the human body and to move in response to movement of the received digit. A separate link is associated with each one of the at least two articulated members. Each link solely mechanically couples the associated articulated member to the actuator associated with the articulated member. Movement of the actuator, caused by movement of the received digit, causes movement of the second portion of the associated articulated member, relative to the first portion of the associated articulated member.

Yet another embodiment of the present invention provides a body-carried or body-worn, mechanically remotely-controlled novelty device. An article of apparel defines an opening and is configured to be removably attached to a portion of a human body, other than a hand, by receiving the portion of the human body within the opening. An articulated member is attached to the article of apparel. The articulated member includes a first portion, a second portion and a third portion. The second portion may be movable, relative to the first portion. The third portion may be movable relative to the second portion. The novelty device also includes a first actuator and a second actuator. Each actuator is configured to receive a digit of the human body and to move in response to movement of the received digit. In practice, each actuator typically accepts a different digit, although one digit could alternate between the two actuators or one digit could be simultaneously accepted by both actuators.

The novelty device also includes a first link and a second link. The first link solely mechanically couples the first actuator to the articulated member. Movement of the first actuator, caused by movement of the digit received by the first actuator, causes movement of the second portion of the articulated member, relative to the first portion of the articulated member. The second link solely mechanically couples the second actuator to the articulated member. Movement of the second actuator, caused by movement of the digit received by the second actuator, causes movement of the third portion of the articulated member, relative to the second portion of the articulated member.

Yet another embodiment of the present invention provides a method for making a body-carried or worn, mechanically remotely-controlled novelty device. According to the method, a novelty device having at least one movable portion is provided. An actuator, configured to receive a digit of a human body and to move in response to movement of the received digit, is also provided. The actuator is mechanically coupled, via a solely mechanical link, to the at least one movable portion of the novelty device. Movement of the actuator, caused by movement of the received digit, causes movement of the at least one movable portion of the novelty device. The novelty device is attached to an article of apparel. The article of apparel defines an opening and is configured to be removably attached to a portion of the human body, other than a hand, by receiving the portion of the human body within the opening.

An embodiment of the present invention provides a method for animating a body-carried or worn, mechanically remotely-controlled novelty device. The novelty device includes at least one movable portion and an article of apparel defining an opening. The novelty device also includes an actuator configured to receive a digit of a human body and to move in response to movement of the received digit. The novelty device also includes a link solely mechanically coupling the actuator to the movable portion of the novelty device, such that movement of the actuator, caused by movement of the received digit, causes movement of the movable portion of the novelty device. The method includes removably attaching the article of apparel to a portion of a human body, other than a hand, by receiving the portion of the human body within the opening. A digit of the human body is received with the actuator. The actuator is actuated by the received digit.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Figure 1:
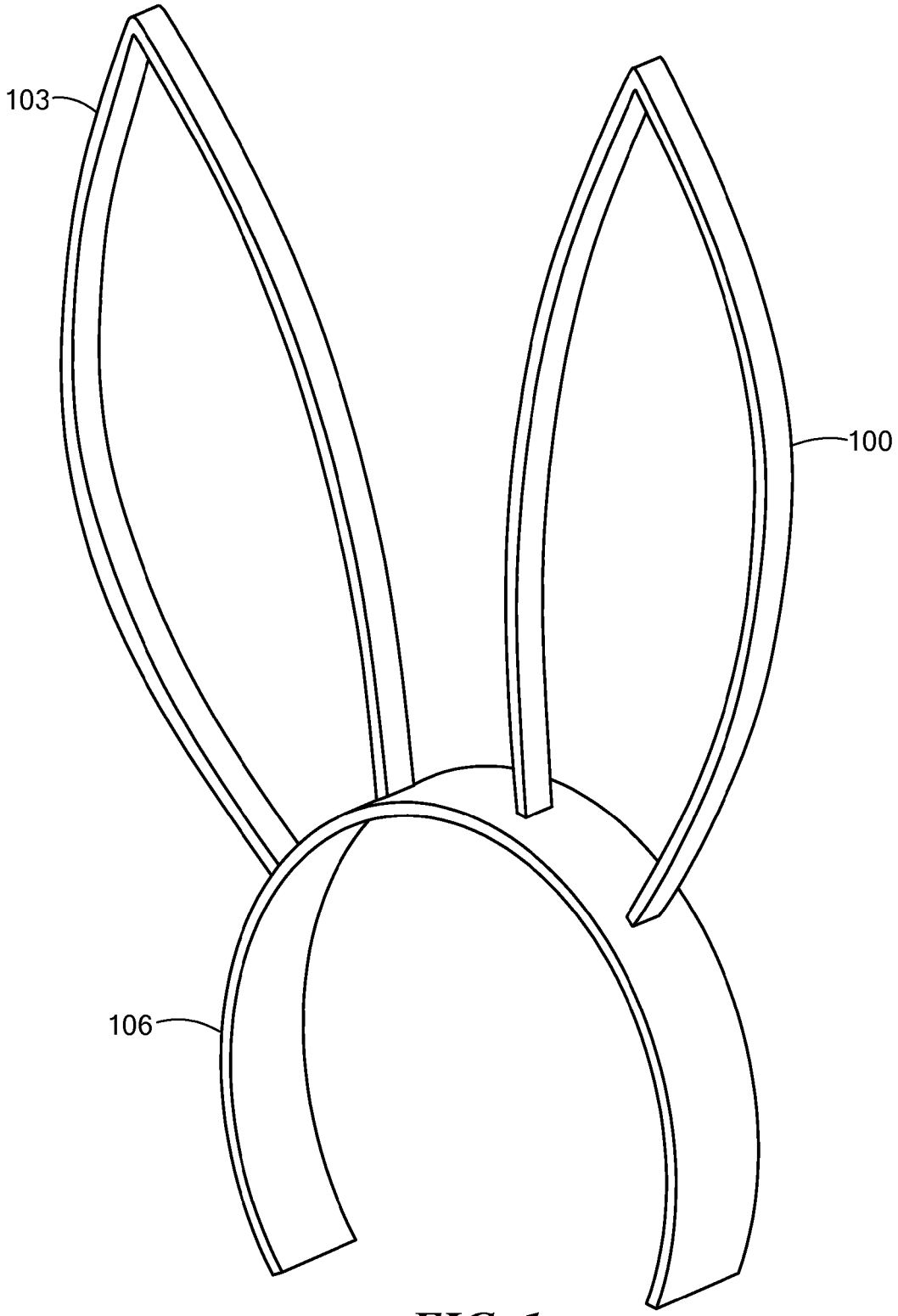
FIG. 1 PRIOR ART
FIG. 1 is a perspective illustration of a "bunny ears" novelty device, according to the prior art.

In accordance with embodiments of the present invention, apparatus are disclosed for body-carried or worn, mechanically remotely-controlled novelty devices and methods for animating such devices. Such a device may include one or more articulated members, each in the shape of an ear, wing, tail, or the like, that may be covertly remotely actuated by a digit, i.e., a finger, thumb or toe, of a human wearer (referred to herein as a "user"). The articulated member(s) may be attached to a headband, hat, cap, hood (such as on a sweatshirt), slipper, another article of clothing, accessory, backpack, or the like (collectively referred to herein as an "article of apparel") worn or carried by the user. The articulated member(s) may be covered with flexible decorative material, such as fabric, real or faux fur, etc., which may be colored to simulate a real or whimsical anatomical feature(s), cartoon character(s), etc.

In some embodiments, a hinged, pivoted or bendable (collectively "movable") portion of each articulated member is mechanically coupled by a Bowden cable that extends over, through or under the user's clothing, down the user's sleeve, to an actuator (such as a ring) proximate the user's hand. In some embodiments, an articulated member includes more than one such movable portion, and a respective Bowden cable mechanically couples each such movable portion to a respective actuator. Each actuator may be worn or otherwise received by, contacted or engaged (collectively "received) by a different one of the user's digits. Bending a finger, wrist, toe or ankle, as the case may be, pulls or pushes the corresponding Bowden cable, which actuates the corresponding movable portion, thereby remotely animating the articulated member.

As used herein, "remotely" means from a location on the same human body, wherein a device that is being "remotely controlled" is worn or carried on the human body and the device is controlled from a location on the same human body. Thus, for example, movement of an articulated member of a novelty device worn on a head of a user may be controlled by actuating a ring worn on a finger of the user. Similarly, movement of an articulated member of a novelty device attached to a slipper worn by a user may be controlled by a toe of the user actuating a lever located within the slipper. However, neither movement is controlled by another person. Thus, the range over which remote control can be performed is limited to a single human body and articles of apparel that are presently worn or carried on the human body.

In some embodiments, levers installed in footwear, such as slippers, sneakers or the like, are coupled to articulated members having shapes, such as mouths or extended toe portions of the footwear, to animate the articulated members. In elaborate embodiments, each finger or toe may actuate a different portion of an articulated member or a portion of a distinct articulated member. For example, movement of one finger may cause two eyes to move from side to side, or each of two fingers may control a separate one of the eyes, while movement of another finger may cause eyelids over the eyes to open or close.

Because the actuators, i.e., the finger rings, toe levers, etc., and the actuating digits can be obscured, such as by an extended shirt sleeve or a slipper body, actuating movements of the user's digits may go unnoticed by casual observers, thereby increasing the amusement value of the devices over merely the novelty of the remotely-controlled articulated members. Optionally or alternatively, the user may hide his or her hand in a pocket and covertly operate a device, even without an extended shirt sleeve.

As noted, static (i.e., non-animated) body-carried or worn amusements, such as a pair of "bunny ears" or "insect antennae" attached to a headband, are well known. FIG. 1 is a perspective illustration of a pair of prior art bunny ears 100 and 103 attached to a headband 106, with decorative covering fabric or fur removed for clarity.

Figure 2:
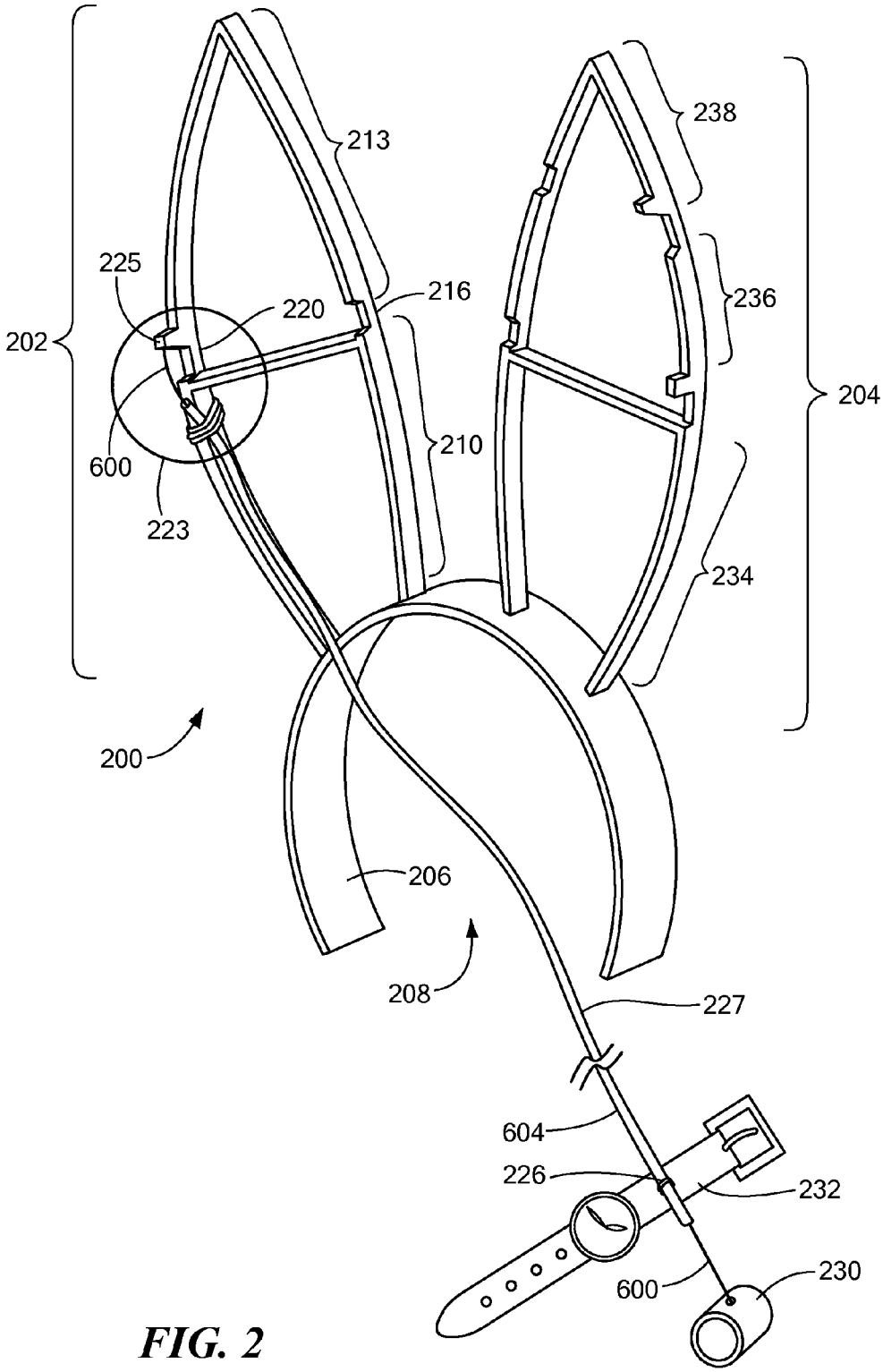
FIG. 2 is a perspective illustration of a body-carried or worn, mechanically remotely-controlled "bunny ears" headband novelty device, according to an embodiment of the present invention.

FIG. 2 is a perspective illustration of one embodiment of the present invention. FIG. 2 illustrates a body-carried or worn, mechanically remotely-controlled "bunny ears" novelty device 200. The device 200 is shown with decorative covering fabric or fur removed for clarity. This embodiment includes first and second articulated bunny ear-shaped frame elements 202 and 204. "Articulated" herein means constructed with one or more joints between respective adjacent portions that allow bending of an overall structure. The joint need not be a separate component. As described below, the joint may be merely a flexible portion between the adjacent portions.

For simplicity, each ear-shaped frame element 202 and 204 may be referred to simply as an "ear" or "ear frame" 202 or 204. The first and second ear frames 202 and 204 are attached to a headband 206, which defines an opening 208 configured to receive a head of the user. The headband 206 may be donned and doffed in a conventional manner.

The first ear frame 202 is divided into a first portion 210 and a second portion 213 that are joined together by portions 216 and 220 of the ear frame 202 that are thinner, and therefore more flexible, than adjacent portions 210 and 213 of the ear frame 202. Although the entire ear frame 202 (and, indeed, the entire device 200) may be fabricated of the same material, such as an injection-molded plastic (such as polypropylene), the two thinner portions 216 and 220 are more flexible than the adjacent portions 210 and 213 of the ear frame 202. Thus, the two thinner portions 216 and 220 form hinges, such as live hinges, where the ear frame element 202 can be bent. The joining portions 216 and 220 form a movable coupling, and the two portions 210 and 213 of the first ear 202 can move, with respect to each other about the movable coupling. Thus, the two portions 210 and 213 and the joining portions 216 and 220 collectively form an articulated member.

Figure 3:
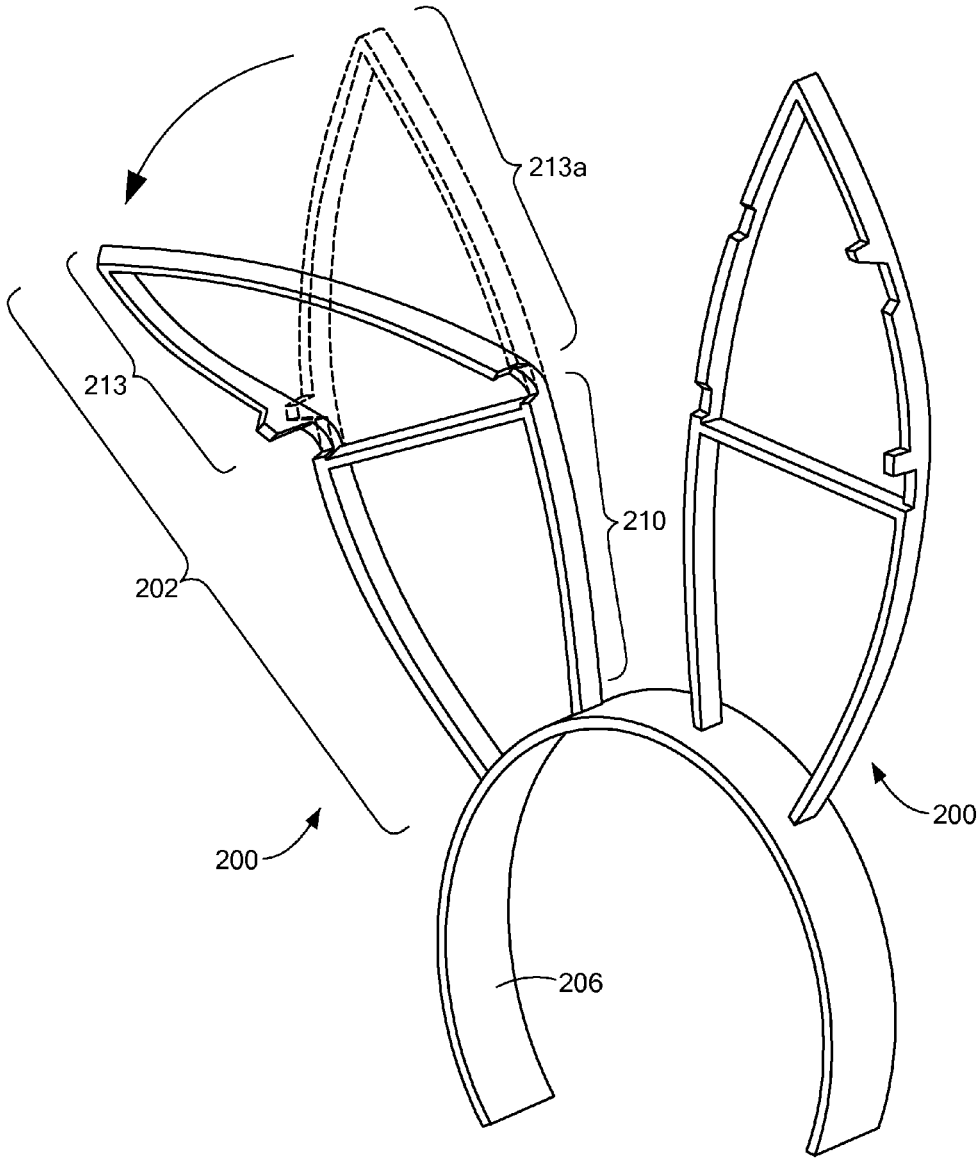
FIG. 3 is a perspective illustration of the device of FIG. 2, with a portion of one ear bent.

FIG. 3 illustrates the ear frame 202 with the second portion 213 bent, with respect to the first portion 210. For reference, the second portion of the ear frame 202 is shown in FIG. 3 in phantom in the unbent position at 213*a*.

In other embodiments the movable coupling may be implemented with another type of hinge, such as a mechanical device including two interconnected wire loops or two interdigitated hinge barrels with a pin engaged therewith. In yet other embodiments, pivots, springs, flexible materials and the like, may be used as movable couplings to join the two adjacent portions 210 and 213 to each other. Thus, the movable coupling may include a mechanical device, in which one part moves with respect to another part. Any suitable movable coupling may be used to join the two adjacent portions 210 and 213 to each other.

Figure 5:
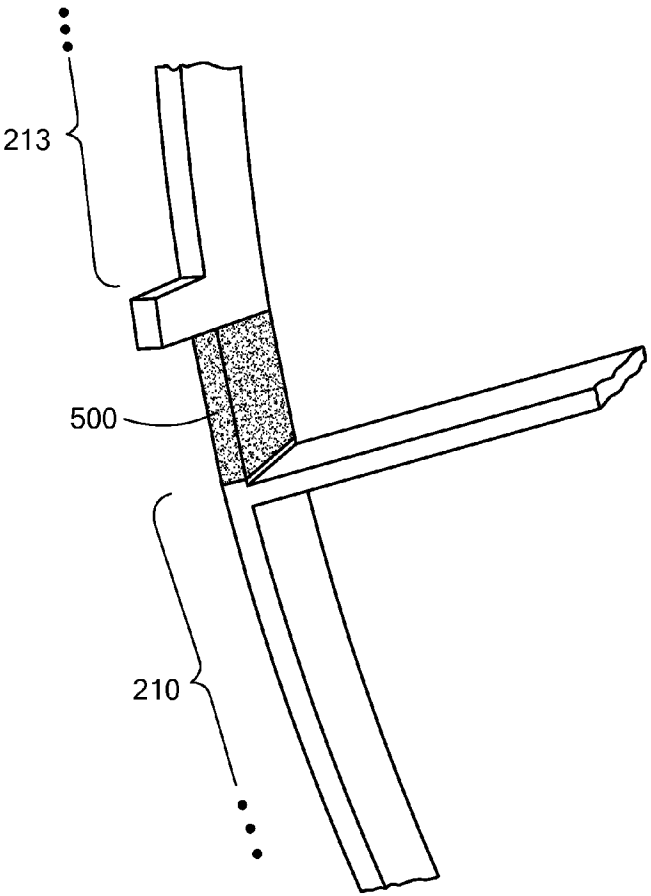
FIGS. 4 and 5 are a close-up perspective views of a portion of the device of FIGS. 2 and 3, according to other respective embodiments of the present invention.
Figure 4:
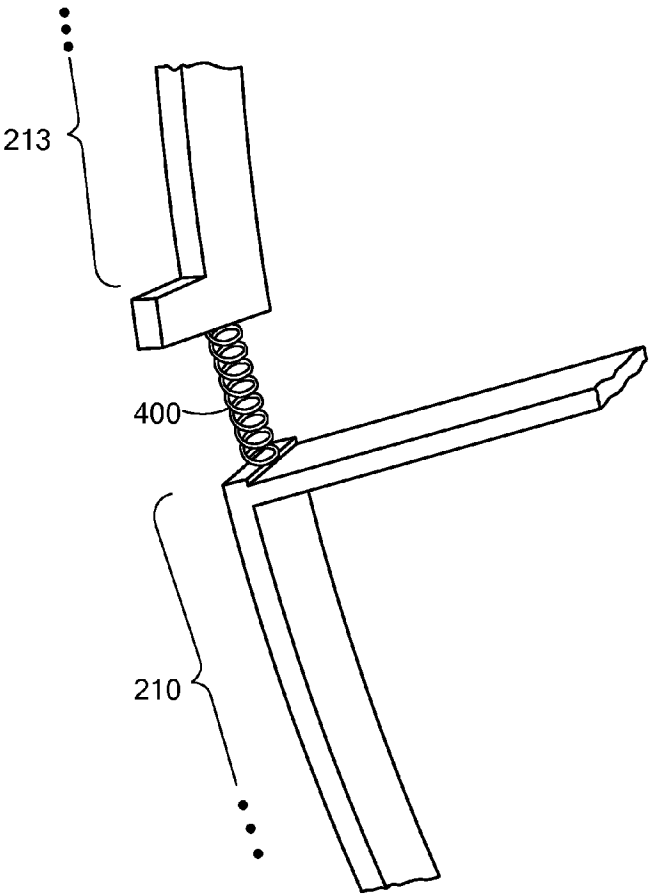

One of the hinges 220 in the ear 202 is enclosed in a circle 223 in FIG. 2. FIGS. 4 and 5 provide enlarged views of the circled portion 223 in other respective embodiments, in which other types of movable couplings between the two adjacent portions 210 and 213 are included. In the embodiment of FIG. 4, the movable coupling includes a wound spring 400. In the embodiment of FIG. 5, the movable coupling includes a portion 500 fabricated from a material, such as a plastic foam, that is more flexible than the material of the two adjacent portions 210 and 213, without necessarily being thinner than the adjacent portions 210 and 213. In some embodiments, the movable coupling may be implemented with a flexible metal or plastic flexure. As used herein, "flexure" means a relatively slender structural element subjected to an external load applied generally perpendicularly to a longitudinal axis of the element and resilient, so as to urge a return to its original shape. The thin portions 216 and 220 shown in FIG. 1 may be flexures.

The movable coupling may, but need not, urge the movable portion 213 to a predetermined position, such as its original position, as shown at 213*a* in FIG. 3. The movable coupling may include a resilient material that elastically deforms as a result of the movement. For example, the thin portions 216 and 220 (FIG. 2) and the form 500 (FIG. 5) may be resilient.

Returning to FIG. 2, a lever 225 is attached to the movable portion 213 of the ear frame 202. The lever 225 may be a separate component attached to the movable portion 213, or the lever 225 may be fabricated as part of the movable portion 213, such as part of a single injection molding process. A Bowden cable 227 is attached at one end thereof to the lever 225 and at its other end to a ring 230. A Bowden cable includes an inner cable extending coaxially through a tube-like outer housing (referred to herein as a "tube") and is used to transmit mechanical force or energy by movement of the inner cable, relative to the tube. The inner cable may be implemented with a single- or multiple-filament wire, string or other suitable material. The tube may be made from a polytetrafluoroethylene (PTFE) (such as Teflon, available from E. I. du Pont de Nemours and Company, Wilmington, Del.), carbon fiber (available from Tower Hobbies, PO Box 9078, Champaign, Ill.) or other suitable material. The tube should be at least somewhat flexible, so it can accommodate a curved route about the user's body.

As noted, the Bowden cable 227 may be disposed over, through or under clothing worn by the user and extend down a sleeve, so the cable 227 is not readily visible. Optionally, the tube of the Bowden cable may be colored, such that the tube is not readily apparent against the clothing.

The ring 230 is sized to be worn by a digit, such as a finger. Thus, in use, the ring 230 receives the digit. Although a ring 230 that completely encircles a digit is shown, in other embodiments the ring encircles less than all, but at least half, of the digit. For example, the ring may be C-shaped. Such an open ring may accommodate a wider variety of digit sizes than a closed ring, particularly if the ring is made of a resilient material. Thus, as used herein, a "ring" includes an open ring. The user may bend or straighten the finger wearing the ring to push or pull the inner cable, relative to the tube of the Bowden cable 227. This action is used to animate the movable portion 213 of the ear 220.

Figure 6:
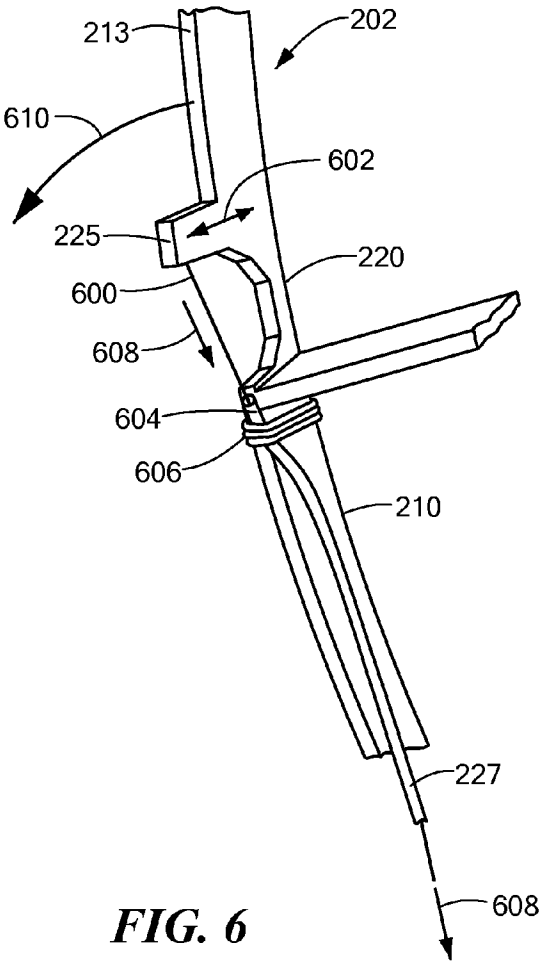
FIG. 6 is a close-up perspective view of a portion of the device of FIGS. 2 and 3.

FIG. 6 is a close-up view of the portion 223 of the ear 202. The inner cable 600 is attached to the lever 225 a distance 602 away from the thinner portion 220 of the ear frame 202. The tube 604 is attached, such as by an adhesive or string binding represented by 606, to the portion 210 of the ear frame 202 other than the portion 213 to which the lever 225 is attached. (Alternatively, the tube 604 may be attached to the lever 225, and the inner cable 600 may be attached to the other portion 210 of the ear frame 202.) Thus, if the inner cable 600 translates, relative to the tube 604, in a direction indicated by arrows 608, the end of the lever 225 where the cable 600 is attached is pulled toward the tube 602 and, consequently, the portion 213 of the ear 202 moves, relative to the other portion 210 of the ear, as indicated by arrow 610. A portion of the ear frame 202 acts as a fulcrum for the lever 225. Thus, the lever 225 provides a mechanical advantage, based on the distance 602.

As used herein, "translation" of an inner cable of a Bowden cable means movement of the inner cable along the length of the tube, even if the tube follows a non-linear path. Thus, translation, in the context of a Bowden cable, is not necessarily strictly a Euclidean translation, in which every point moves a constant distance in a specified direction.

Returning to FIG. 2, a portion 226 of the tube of the Bowden cable 227 near the ring 230 may be attached to a wrist band 232, such as a wrist watch band, bracelet or the like, or to an inside surface of a shirt sleeve, to prevent the portion 226 of the Bowden cable 227 tube from moving when the user bends or straightens his or her ring-wearing digit. Thus, the wrist band 232, etc. provides a "reference position member," and translation of the inner cable 600 is relative to the reference position member. The reference position member defines an opening, such as the opening of a wrist band, and is configured to be removably attached to at least a portion of an appendage, such as an arm, of the user by receiving the portion of the appendage within the opening. The reference position member need not completely encircle the appendage, as long as the reference position member may be relatively securely attached to the appendage, to prevent significant movement of the reference position member in the direction the cable 600 is to translate.

Figure 7:
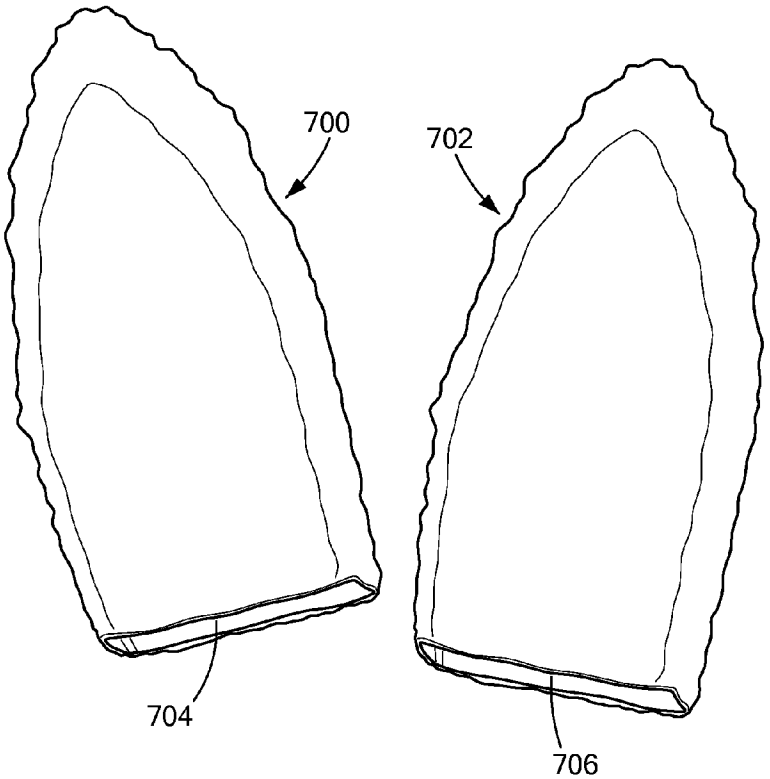
FIG. 7 is a perspective view of coverings for the ears of the devices of FIGS. 2-6.

FIG. 7 is a perspective illustration of cloth coverings 700 and 702 for the ears 202 and 204 (FIG. 2). The cloth coverings 700 and 702 may define openings 704 and 706 that receive the ears 202 and 204, respectively. Other portions of the device 200, such as the headband 206, may also be covered with cloth to hide the Bowden cable 227 and/or improve aesthetics of the device 100.

Returning to FIG. 2, the second ear 204 may be divided into the same or a different number of portions than the first ear 202. In the device 200 shown in FIG. 2, the second ear 202 is divided into three portions 234, 236 and 238. However, in other embodiments, each ear 202 and 204 may be divided into other respective numbers of portions. A body-carried or worn, mechanically remotely-controlled novelty device, according to the present invention, may include any number of articulated members that can be controlled by one or more digits of the user. In any given embodiment, each articulated member may be divided into a suitable number of portions, depending on considerations, such as the number of degrees of freedom of movement desired to animate the articulated member and the number of user digits available for controlling the portions.

Figure 8:
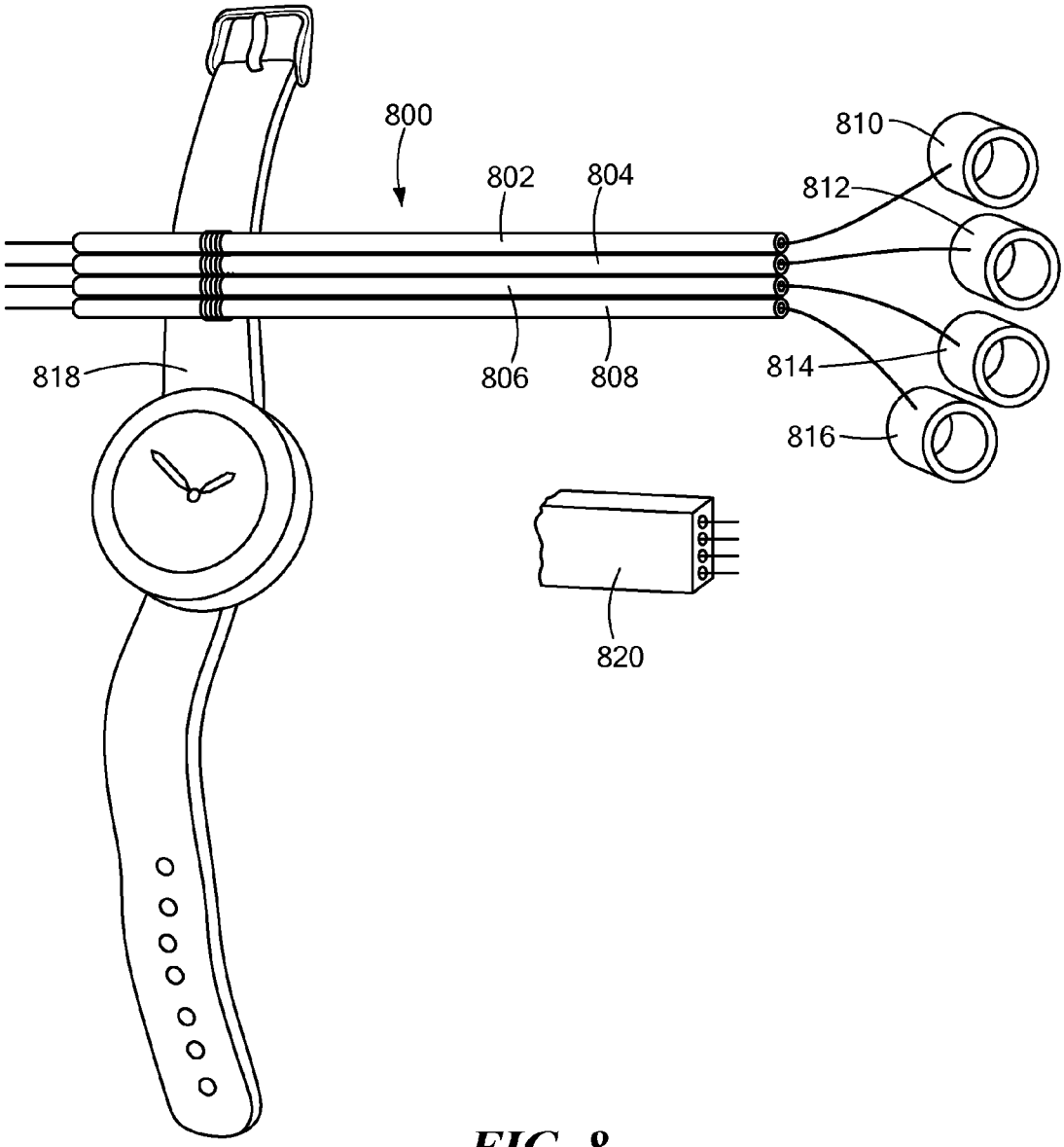
FIG. 8 is a perspective view of a bundle of Bowden cables, and a multi-bore Bowden cable, connected to respective rings that may be used to animate one or more articulated members of the embodiments of FIGS. 2-7 and 10-19, according to embodiments of the present invention.

FIG. 8 is a perspective view of a bundle 800 of four Bowden cables 802, 804, 806 and 808, connected to respective ring actuators 810, 812, 814 and 816, that may be used to animate an articulated member with four movable portions, two articulated members each with two movable portions or other combinations of numbers of articulated members and movable portions. The ring actuators 810-816 may be color coded or otherwise coded or include indicia to correlate the actuators 810-816 with respective movable portions and/or articulated members.

The bundle 800 is shown attached to a wrist watch band 818, as discussed above. Of course, other numbers of Bowden cables may be bundled together, depending on the number of articulated members and/or movable parts to be individually remotely controlled. Alternatively, instead of separate Bowden cables 802-808 bundled together, a single flexible multi-bored housing 820 may be used. A relatively flat "ribbon" housing 820 has a relatively low profile and should be relatively simple to hide on top of, within or under clothing. However, other configurations of bores, such as 2×2, and other numbers of bores may be used.

Figure 9:
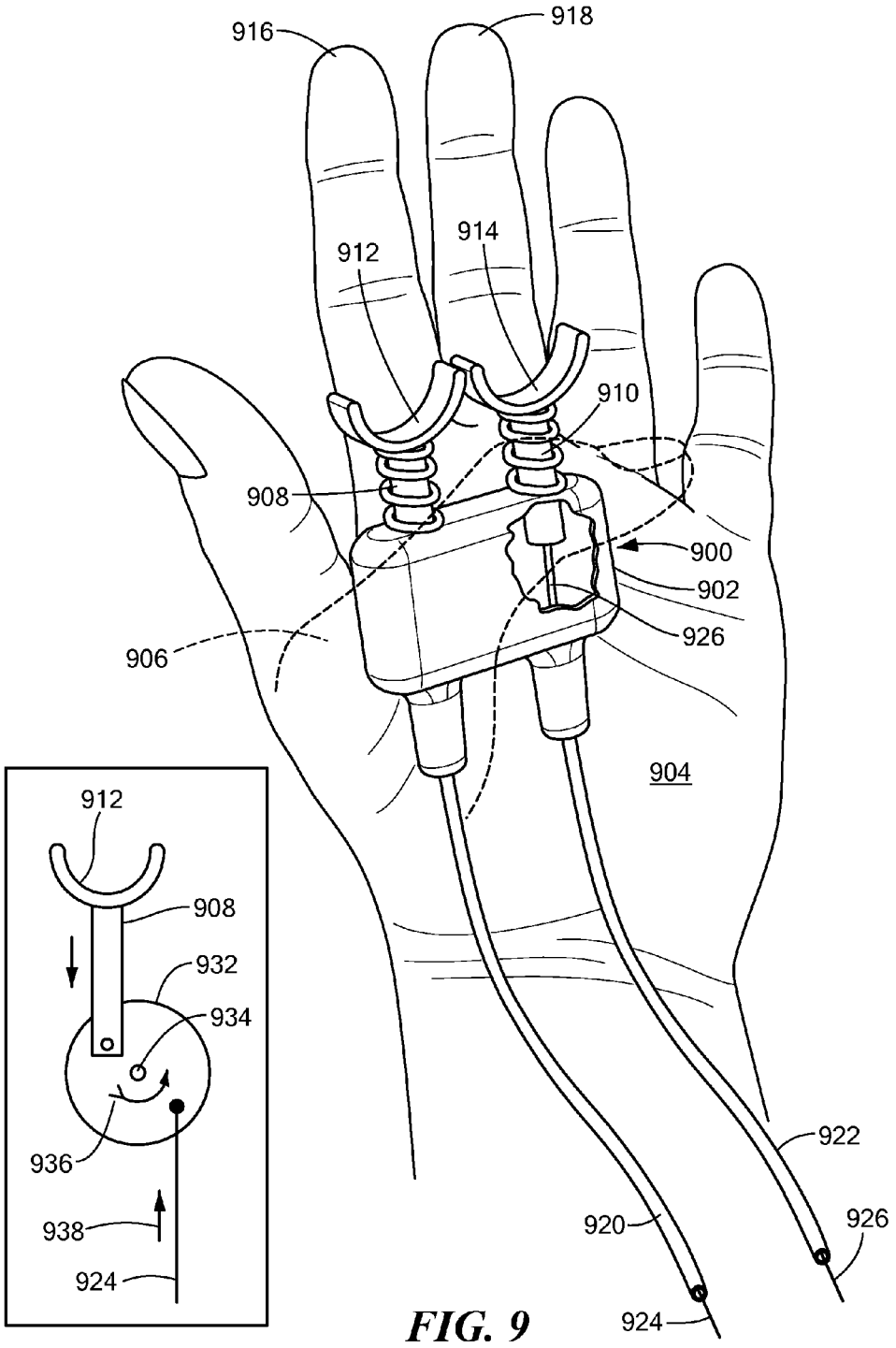
FIG. 9 is a perspective view of an actuator for the novelty devices of FIGS. 2-7 and 10-19, according to an another embodiment of the present invention.

FIG. 9 is a perspective view of an alternative actuator assembly 900, according another embodiment of the present invention. The actuator assembly 900 includes a housing 902 sized and shaped to fit in the palm 904 of a user. A portion of the housing 902 is shown cut-away to reveal internal components thereof The user may hold the housing 902 relatively stationary, relative to the user's palm 904, such as by pressing a bent thumb against the housing 902, as indicated in phantom at 906, thereby pressing the housing 902 against the palm 904. Thus, the reference position member discussed above, with respect to FIG. 2, may not be necessary and, in some contexts, the actuator assembly 900 may be preferred over the ring actuator described above, with reference to FIGS. 2 and 8.

Two spring-loaded actuators 908 and 910 define generally U-shaped curved rests 912 and 914, which are sized and shaped to receive respective fingers 916 and 918, when these fingers 916 and 918 are bent or curled (not shown). Further bending or curling of one or more of the fingers 916 and 918 depresses the respective actuator(s) 908 and 910. The actuators 908 and 910 may be color coded or include indicia, as discussed above, with respect to the rings 810-816. Optionally or alternatively, the housing 902 may include color or other coding or indicia to correlate the actuators 908 and 910 with articulated members or movable portions thereof.

Bowden cables 920 and 922 are mechanically coupled to the actuators 908 and 910, respectively, such that the respective inner cables 924 and 926 are made to translate, relative to the housing 902, when the corresponding actuators 908 and 910 are depressed. The tubes of the Bowden cables 920 and 922 are attached to the housing 902. Depressing one of the actuators 908 or 910 may cause the corresponding inner cable 924 or 926 to translate in a direction away from the housing 902. In other words, depressing an actuator 908 or 910 may push the respective inner cable 924 or 926.

Optionally or alternatively, as shown in an insert in FIG. 9, a disk or lever 932 may be mounted on a pivot 934 inside the housing 902, and one of the actuators (here exemplified by actuator 908) and the corresponding inner cable 924 may be mechanically coupled to the disk or lever 932, such that depressing the actuator 908 causes the disk or lever 932 to pivot, as indicate by arrow 936, which causes the inner cable 924 to translate in a direction toward the housing 902, as indicated by arrow 938. In other words, depressing the actuator 908 may pull the inner cable 924.

Although FIG. 9 shows an actuator assembly 900 with two actuators 908 and 910, other embodiments may include other numbers of actuators, including one and numbers greater than four or five. Each actuator may, but need not, be actuated by a dedicated finger. In addition, each finger may, but need not, actuate a dedicated actuator. Optionally, the actuator assembly 900 may include an actuator (not shown) that may be actuated by the thumb. Any combination of push or pull actions may be included in the actuator assembly 900. Another embodiment (not shown) includes levers or keys (similar to small piano keys) on the housing 902, instead of "plunger-type" actuators 908 and 910.

Figure 10:
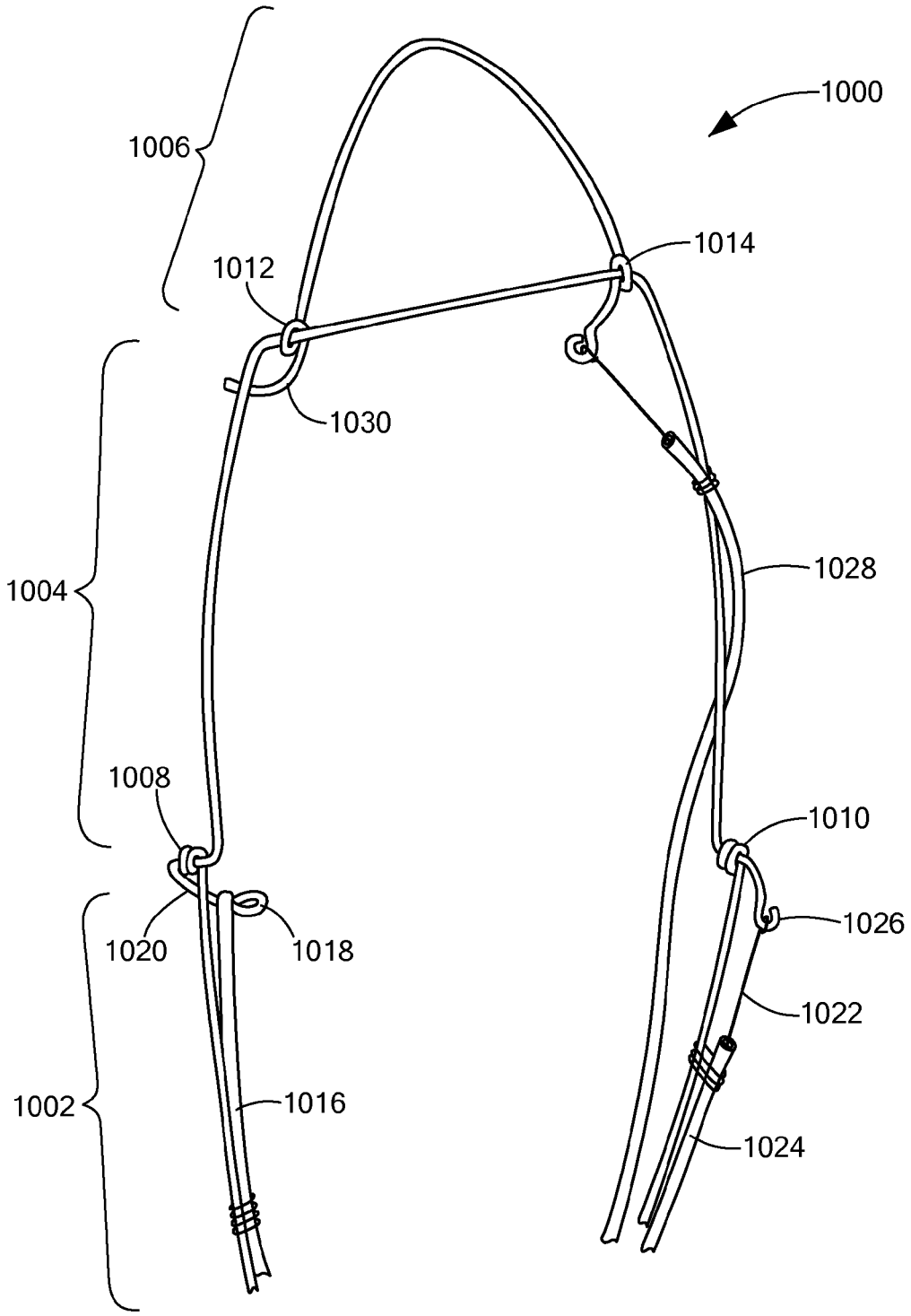
FIG. 10 is a front view of a wire frame ear-shaped device, according to an embodiment of the present invention.

As noted, the embodiments described above, with respect to FIGS. 2-6, may be fabricated using conventional injection molding techniques. In other embodiments, ear frames may be made of bent wire. FIG. 10 is a front view of a wire frame ear 1000, according to an embodiment of the present invention. The ear 1000 includes three portions 1002, 1004 and 1006. In the bottom portion 1002, the wire defines hinges 1008 and 1010 to permit the middle portion 1004 to move (pivot), relative to the bottom portion 1002. Similarly, the top portion 1006 defines hinges 1012 and 1014 to permit the top portion 1006 to move (pivot), relative to the middle portion 1004. An elastic band 1016 is connected between a portion of the bottom portion 1002 and a lever extension 1018 of the middle portion 1004 to urge the middle portion 1004 toward a predetermined position. The lever extension 1018 is shaped to rest against the bottom portion 1002 at 1020 when the middle portion 1004 is in the predetermined position, to prevent the middle portion 1004 from pivoting too far about the hinges 1008 and 1010.

An inner cable 1022 of a Bowden cable 1024 is attached to another lever 1026 to drive the middle portion 1004, in a manner similar to that discussed above, with respect to FIG. 6. A second Bowden cable is similarly coupled to the top portion 1006. The top portion 1006 also includes a lever extension 1030 shaped and oriented to prevent the top portion 1006 from pivoting backwards beyond a predetermined position, such as vertical.

Figure 11:
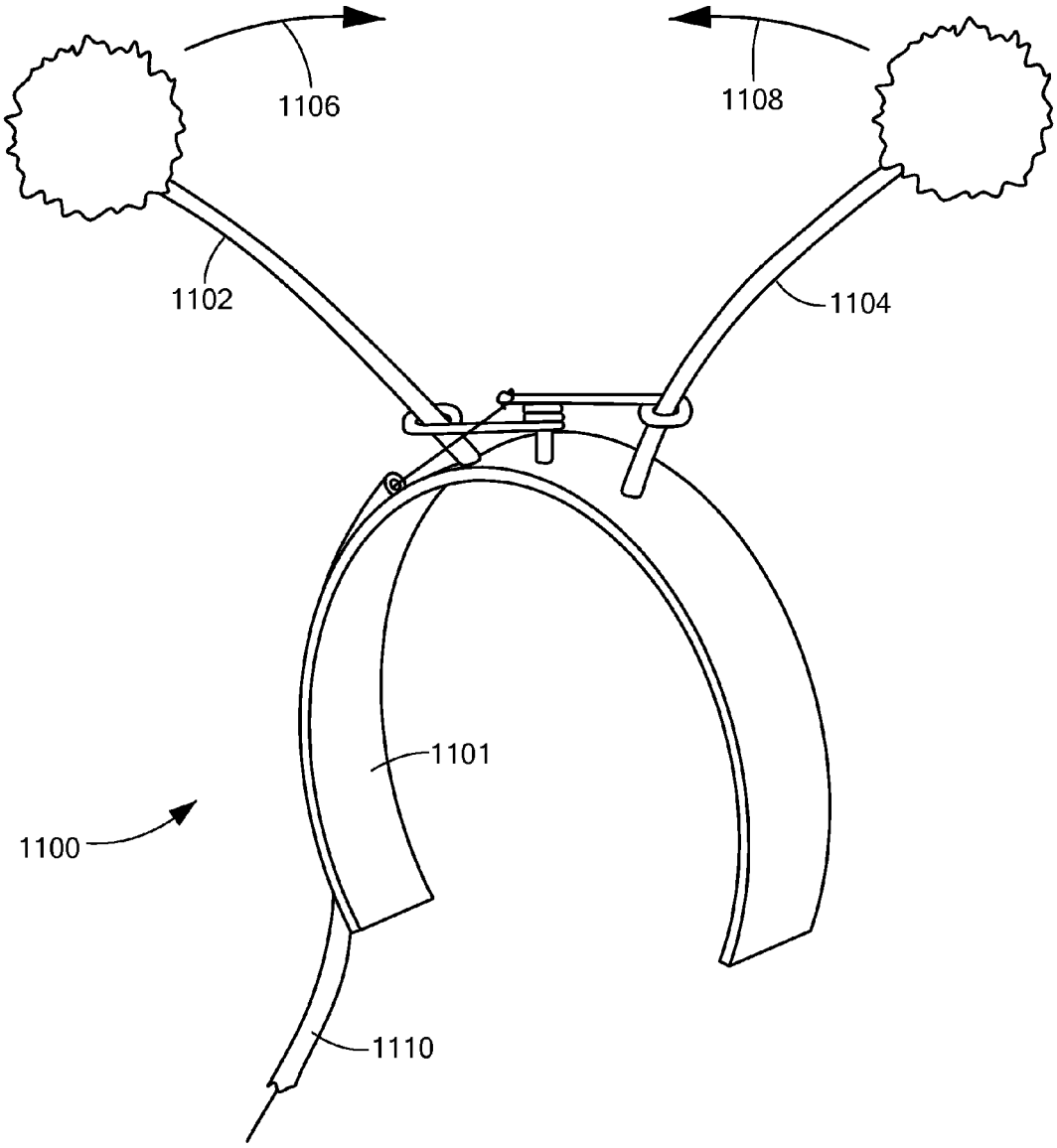
FIG. 11 is a perspective illustration of an "insect antenna" device, according to an embodiment of the present invention.
Figure 12:
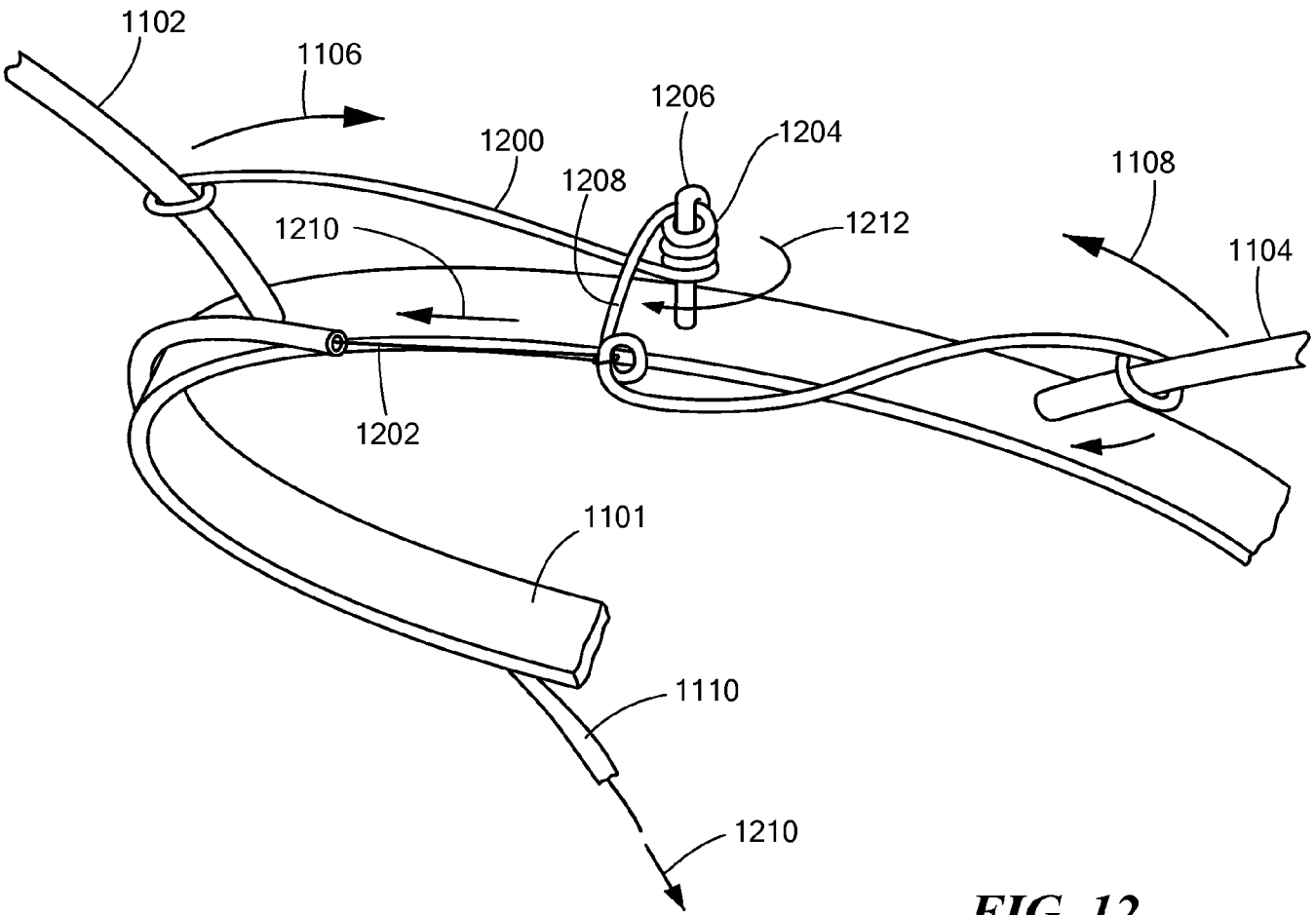
FIG. 12 is a close-up perspective view of a portion of the device of FIG. 11.

Other embodiments of the present invention may include articulated members having other shapes. For example, FIG. 11 is a perspective illustration of an "insect antenna" device 1100 that includes a headband 1101. Two antennae 1102 and 1104 move as indicated by respective arrows 1106 and 1108 when the Bowden cable 1110 is activated. FIG. 12 is a close-up perspective view of the mechanism of the device 1100 of FIG. 11. A bent wire 1200 connects the two antennae 1102 and 1104 to the inner cable 1202 of the Bowden cable 1110. The other end of the Bowden cable 1110 is coupled to a ring or other actuator (not shown), as discussed above.

The wire 1200 includes a hinge portion 1204 wound around a pivot pin 1206 projecting from the headband 1101. The wire 1200 also includes a lever portion 1208, to which the inner cable 1202 of the Bowden cable 1110 is attached. When the inner cable 1202 translates in a direction indicated by arrows 1210, the inner cable 1202 pulls on the lever portion 1208, causing the wire 1200 to rotate (in some embodiments, at least about ten degrees) about the pivot pin 1206, as indicated by arrow 1212, which causes the antennae 1102 and 1104 to be drawn in, toward the pivot pin 1206, as indicated by the arrows 1106 and 1108. As noted above, portions of the device 1100 may be covered by a suitable decorative cloth, fur, etc.

Figure 13:
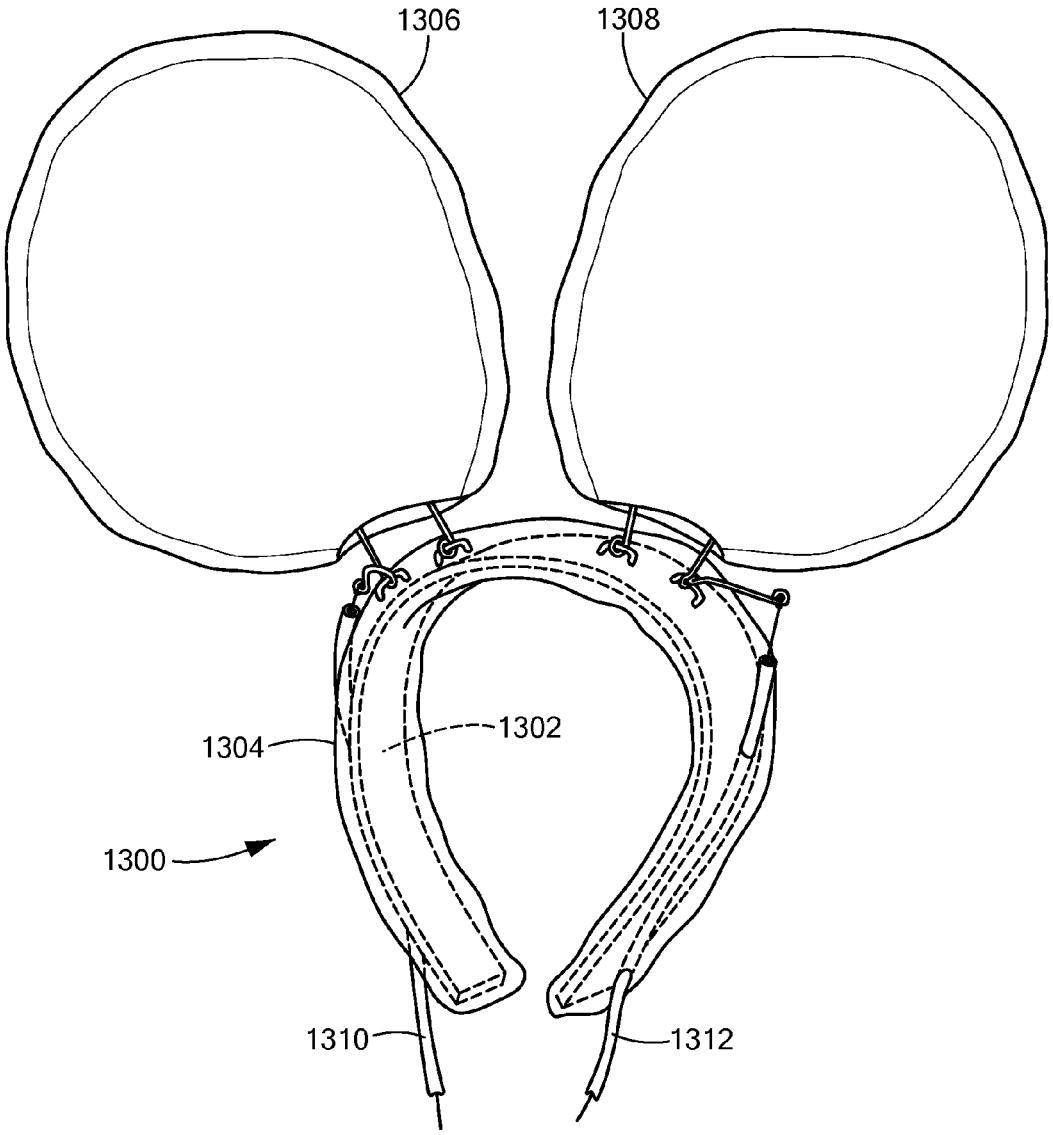
FIG. 13 is a front view of an "elephant ears" device, according to an embodiment of the present invention.

FIG. 13 is a front view of an "elephant ear" device 1300, according to another embodiment of the present invention. A headband 1302 (shown in phantom) may be covered by a suitable cloth, fur, etc. material 1304. Two ears 1306 and 1308 may be animated using respective Bowden cables 1310 and 1312 and actuators (not shown), in a manner similar to that discussed above.

Figure 14:
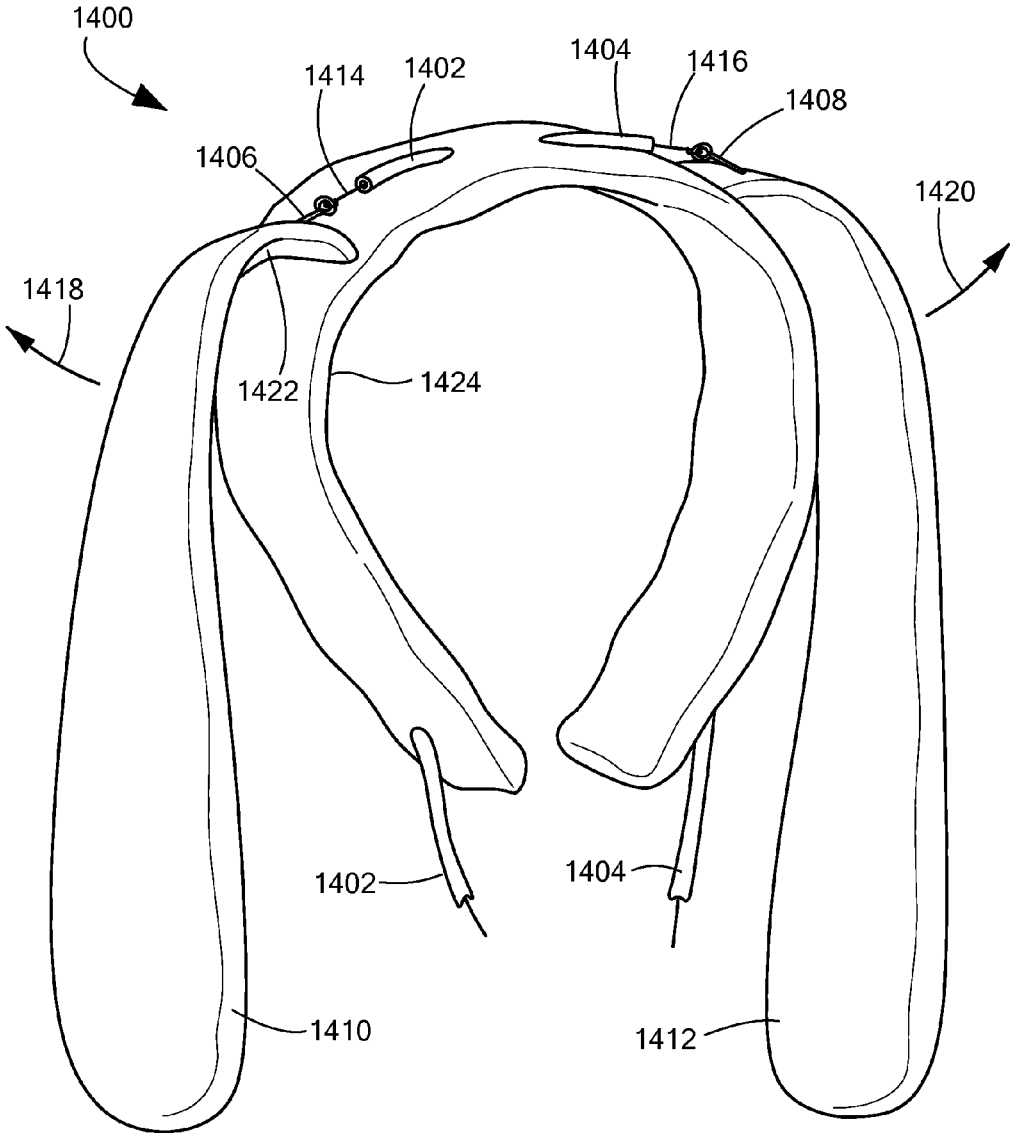
FIG. 14 is a front view of a "floppy ears" device, according to an embodiment of the present invention.

FIG. 14 is a front view of a "floppy ears" device 1400, according to another embodiment of the present invention. Bowden cables 1402 and 1404 are coupled to respective frame members 1406 and 1408 in the respective ears 1410 and 1412. When the respective inner cables 1414 and 1416 of the Bowden cables 1402 and 1404 translate, the ears 1410 and 1412 move, as indicated by respective arrows 1418 and 1420. In this embodiment, all or most of the ear 1410 forms the movable portion of the articulated member, and a small portion 1422 of the ear and/or a small portion of the headband 1424 forms the other portion of the articulated member, with respect to which the movable portion moves.

Figure 15:
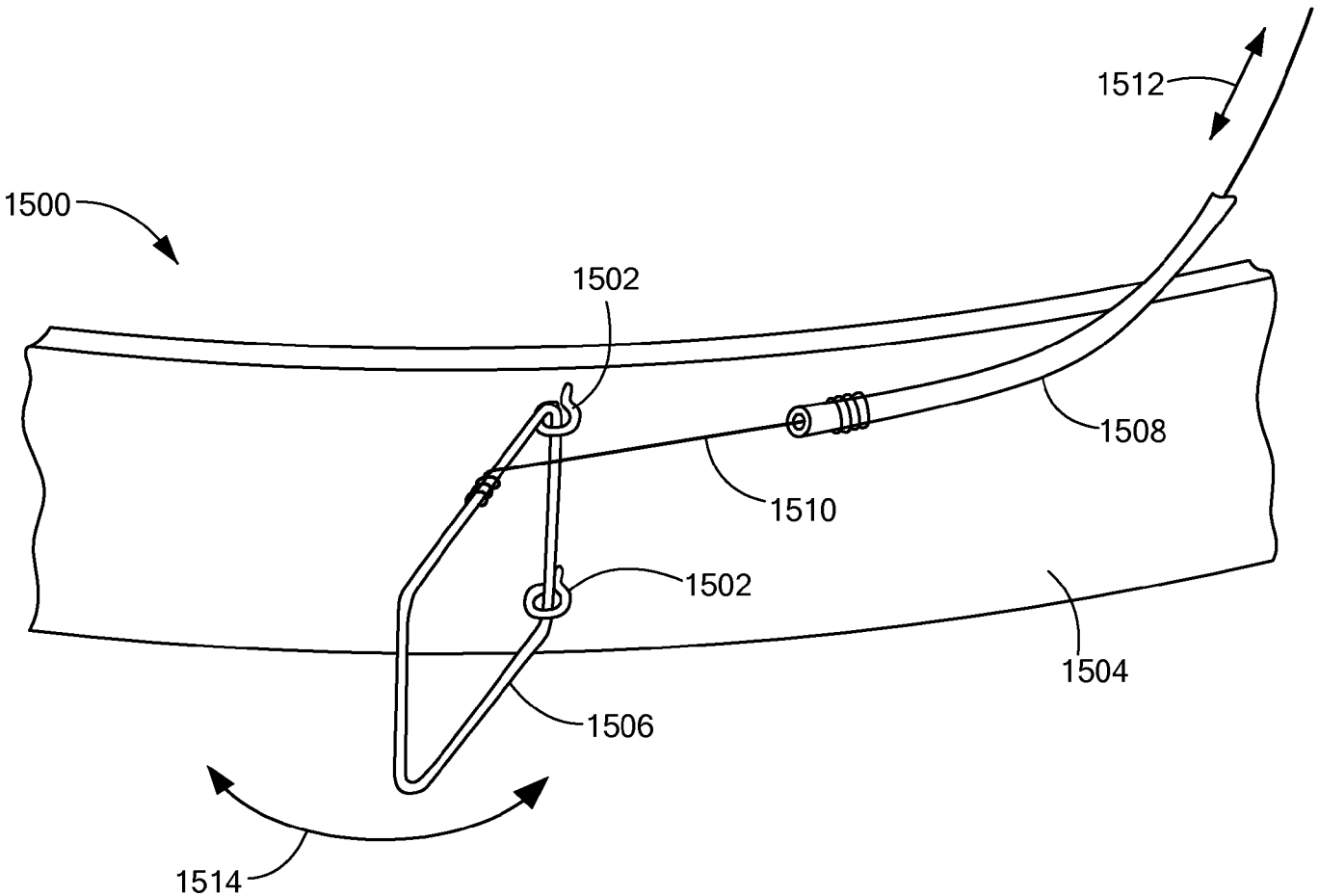
FIG. 15 is a perspective view of a "tail" device, according to an embodiment of the present invention.

FIG. 15 is a perspective view of a "tail" device 1500, according to another embodiment of the present invention, with decorative covering (such as a fuzzy "cotton tail") removed for clarity. A hinge 1502 is attached to a belt 1504 or other suitable article of clothing, such as pants. A frame member 1506 is pivotally mounted to the hinge 1502. A Bowden cable 1508 is attached to the belt 1504, and the inner cable 1510 is attached to the frame member 1506, such that translating the inner cable 1510, as indicated by arrow 1512, causes the frame member 1506 to "wag," as indicated by arrow 1514.

Figure 16:
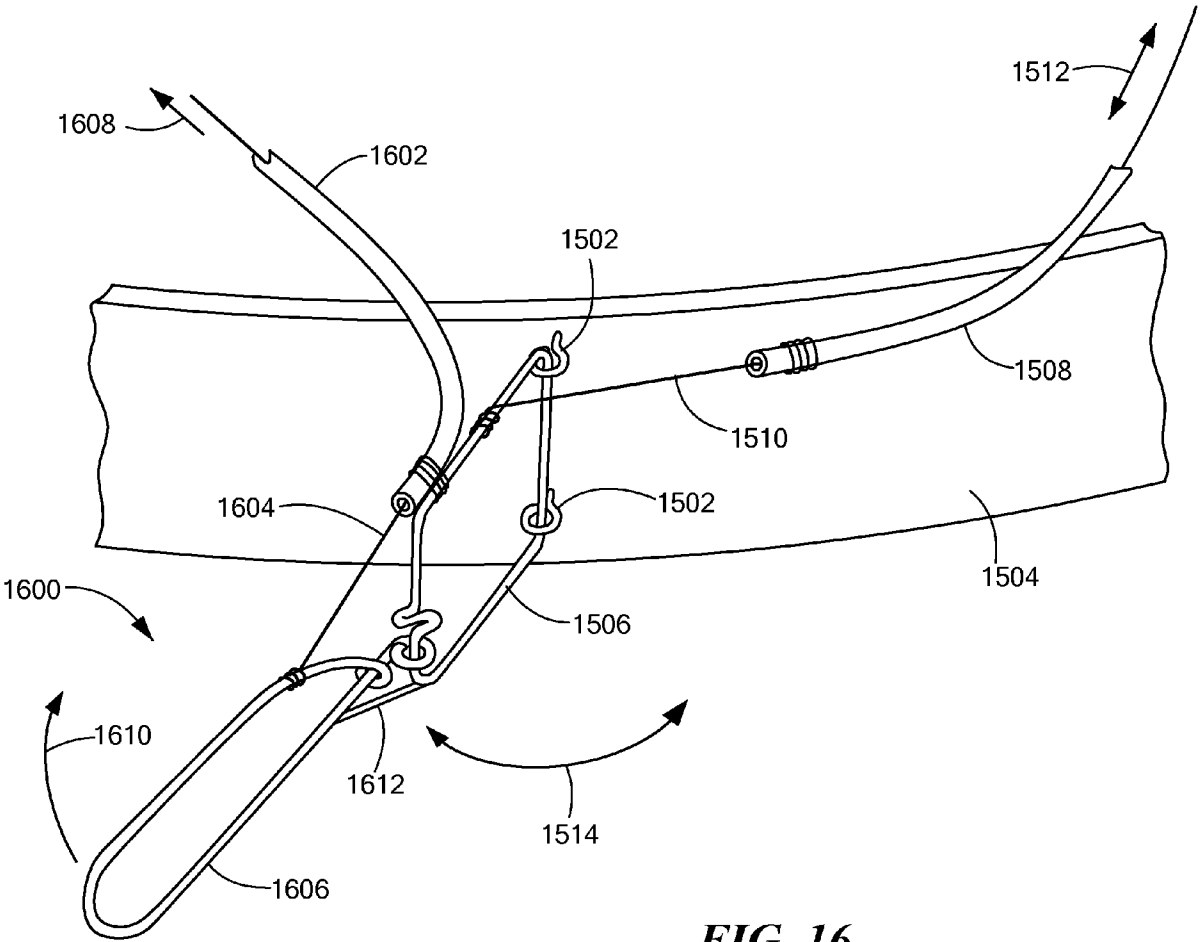
FIG. 16 is a perspective view a "tail" device that includes non-coplanar movements, according to another embodiment of the present invention.

FIG. 16 is a perspective view a "tail" device 1600 that includes orthogonal or other non-coplanar movements, according to another embodiment of the present invention, with decorative covering removed for clarity. Movement in one plane, such as lateral movement, as indicated by arrow 1514, may be implemented, as described above with respect to FIG. 15. A second Bowden cable 1602 may be attached to the frame member 1506, and its inner cable 1604 may be attached to a pivoted second frame member 1606. Thus, translation of the inner cable 1604, as indicated by arrow 1608, causes the second frame member 1606 to move, as indicated by arrow 1610, in a different plane. The weight of the second frame member 1606 and/or decorative covering may provide sufficient weight to return the second frame member 1606 to its original position, once pulling force on the inner cable 1604 is released. Optionally, a spring, elastic band or other suitable resilient member 1612 may be included to urge the second frame member 1606 to return to its original position.

Figure 17:
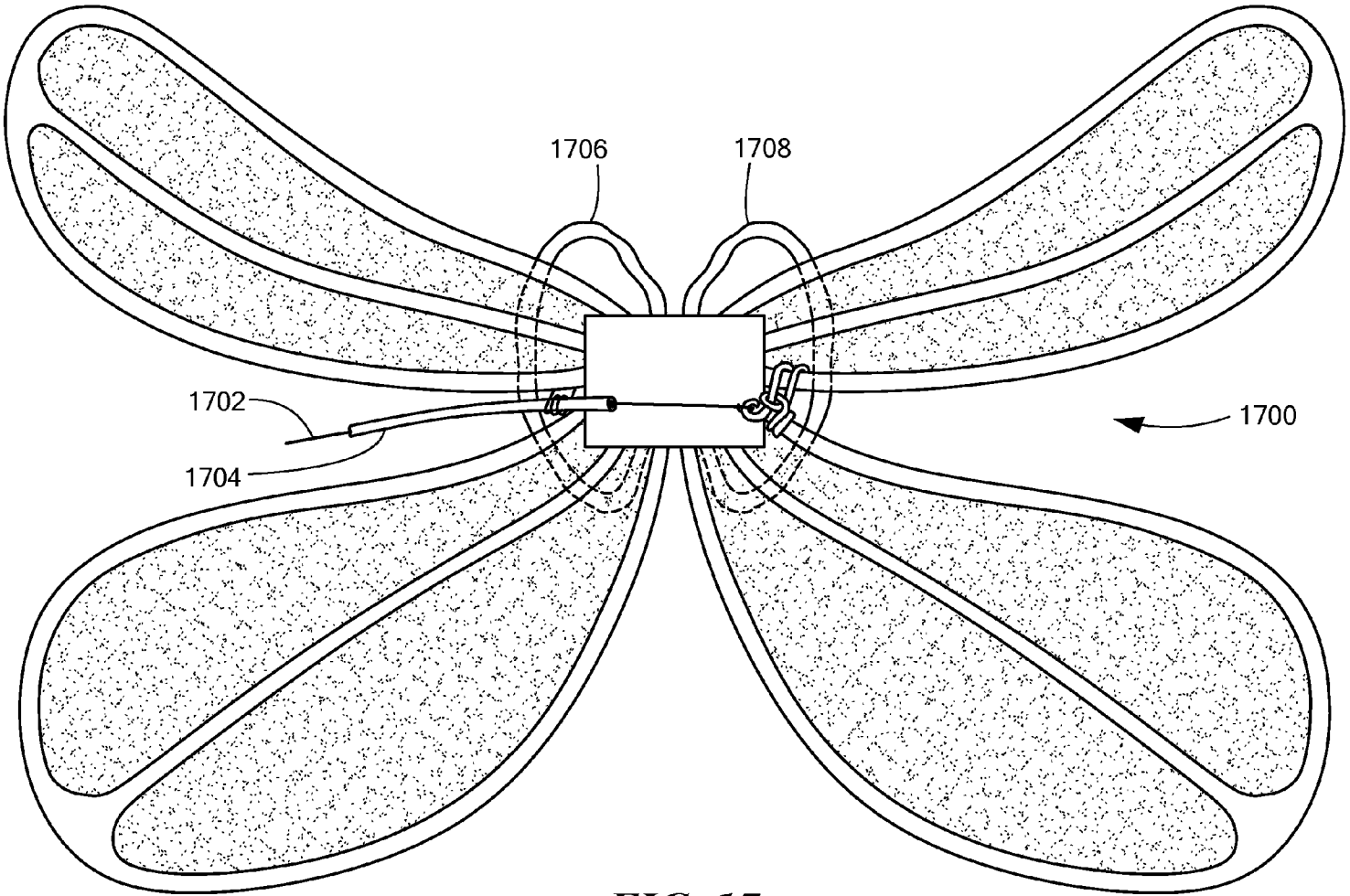
FIG. 17 is a front view of a "fairy wings" device, according to an embodiment of the present invention.

FIG. 17 is a front view of a "fairy wings" device 1700, according to another embodiment of the present invention. As the inner cable 1702 of the Bowden cable 1704 is pulled, the wings "flap." Elastic shoulder straps 1706 and 1708 receive respective arms and/or shoulders of a user.

Figure 18:
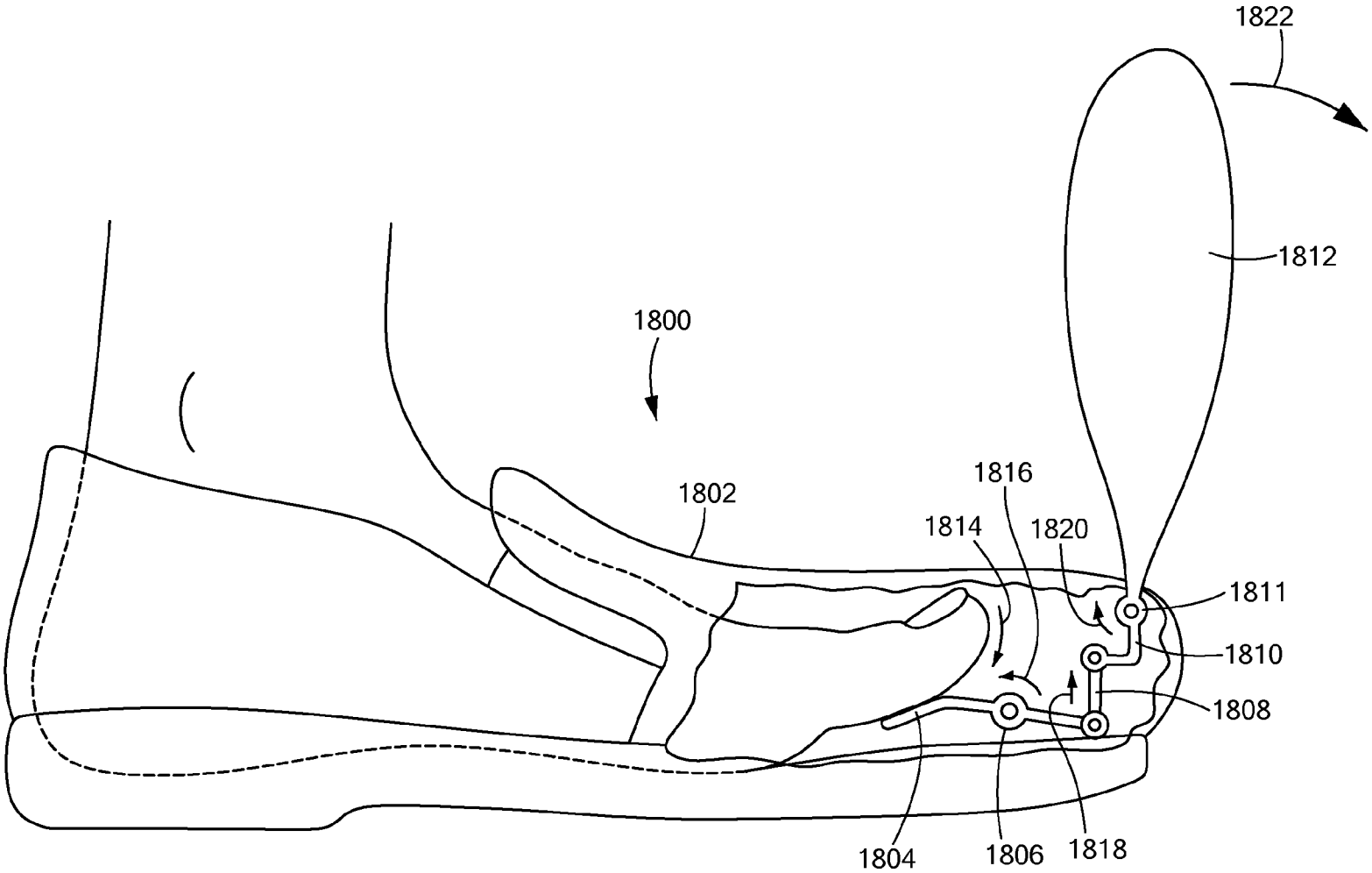
FIG. 18 is a cut-away side view of a body-worn, mechanically remotely-controlled "bunny ears" slipper novelty device, according to another embodiment of the present invention.

FIG. 18 is a cut-away side view of a "bunny ears" device 1800, according to another embodiment of the present invention. The device 1800 is in the general shape of a slipper 1802 or other footwear. A first lever 1804 inside the slipper is sized, shaped and positioned to receive, contact or be engaged by a toe, (here exemplified by a big toe), however the first lever 1804 may be positioned to be engaged by one or more other toes. The first lever 1804 pivots about a pin 1806. The first lever 1804 is mechanically coupled via a link 1808 to a second lever 1810, which pivots about a pin 1811. The second lever 1810 is mechanically coupled to one or more ears 1812 that extend outside the slipper 1802, such that movement of the second lever 1810 causes movement of the one or more ears 1812.

Pressing down on the first lever 1804, as indicated by arrow 1814, causes the first lever 1804 to pivot, as indicated by arrow 1816, which causes the link 1808 to translate, as indicated by arrow 1818. This translation 1818 causes the second lever 1810 to pivot, as indicated by arrow 1820, thereby causing the one or more ears 1812 to move, as indicated by arrow 1822. A spring, elastic or other suitable resilient member (not shown) may be included to urge the first lever 1804, the link 1808, the second lever 1810 or the one or more ears 1812 to return to a predetermined position.

In an alternative embodiment (not shown), the first lever is mounted within the slipper, such that the user activates the lever by raising his or her toe, rather than pressing down with the toe. In one such embodiment, raising the toe, thereby releasing the lever from a "down" position activates the mechanism. In another such embodiment, the activation portion of the lever is mounted above the toe, such that raising the toe causes the top of the toe to contact and lift (rather than press down) the lever.

Figure 19:
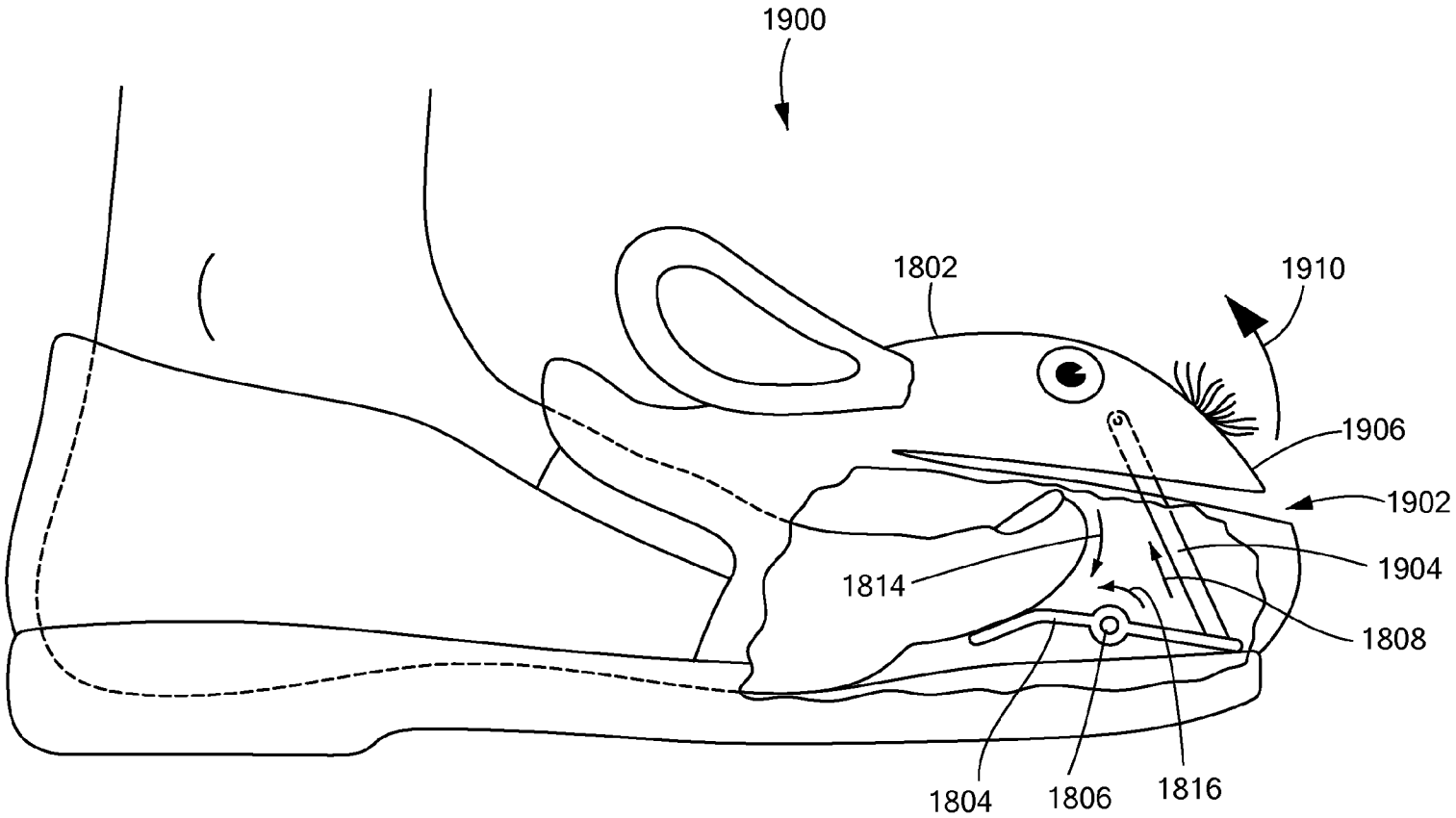
FIG. 19 is a cut-away side view of a body-worn, mechanically remotely-controlled "bunny mouth" slipper novelty device, according to yet another embodiment of the present invention.

FIG. 19 is a cut-away view of a "bunny mouth" device 1900, according to yet another embodiment of the present invention. The bunny mouth device 1900 is similar to the bunny ears device 1800 of FIG. 18, except the slipper 1802 includes an articulated mouth 1902, and the link (here indicated at 1904) is mechanically coupled to a movable portion 1906 of the articulated mouth 1902, such that translation of the link 1904, as indicated by arrow 1908, causes the articulated mouth 1902 to open, as indicated by arrow 1910.

Many variations on the slipper devices of FIGS. 18 and 19 are contemplated. These variations include, without limitation, substituting or augmenting the ears 1812 or mouth 1902 with other anatomical features, such as an eye or an eyelid, or whimsical shapes, such as curled, extended, tapered toes that uncurl when a lever is actuated.

Other variations on the devices described with respect to FIGS. 2-17 are also contemplated. These variations include substituting or augmenting the disclosed articulated members with other anatomical features or whimsical shapes, such as a generally conical, partially pleated (crumpled) "wizard hat" configured to change shape (for example, similar to the shape changes exhibited by the "Sorting Hat" in the motion picture "Harry Potter and the Philosopher's Stone") in response to actuation by a user. In one such embodiment, the wizard hat defines an articulated mouth portion that includes at least one movable portion coupled to an actuator. The conical portion of the wizard hat may be configured to change shape, such as by tilting from its original axis of the cone or extending and compressing along the axis, in response to actuation by a user. Optionally or alternatively, the brim of the wizard hat may be configured to change shape, such as by distorting, in response to actuation by the user. Other variations include, without limitation, anthers, horns, a mouth, a lip, a nose, an eye, an eyelid, a heart, an arm and a leg.

Articulated members attached to headbands, hats and the like have been described. However, articulated members may be attached to other articles that may be worn or carried by a user. In one such embodiment, one or more articulated members, such as a member in the shape of a nose, may be attached to a face mask and animated, as described herein.

As used herein, terms such as "link," "mechanically remotely-controlled" and "mechanically coupling" mean only mechanical components are used to transfer movement between two locations or to control one component by another component. The movement may be, without limitation, translation or rotation. No electrical or electronic components, such as wired or wireless radio frequency (RF) or optical transmitters or receivers, are used to cause the movement or control. However, electronic devices, such as sound or light generators that are triggered as a result of a user actuating an articulated member or movable portion thereof, by be included. Although embodiments that include Bowden cables have been described, other forms of translating or rotating control cables, with or without outer tubes, or other types of mechanical links may be used.

As used herein, an actuator that receives, contacts or is engaged by a digit, such as a ring worn on a finger (as described with reference to FIGS. 2 and 8) or a key or a U-shaped actuator (as described with reference to FIG. 9), does not include merely a string, grasp member or the like that is grasped, such as between two digits, and pulled to actuate, without a tube coaxially around the string and extending along most of the length of the string. As used herein, "actuator" means an object that receives, contacts or is engaged by a digit and includes a shape-retaining portion that is touched by the digit during actuation. "Shape-retaining" means rigid or resilient, when subjected to forces likely to be encountered in the uses described herein. Thus, the rings described with reference to FIGS. 2 and 8 may be made of hard or resilient plastic. However, "shape-retaining" specifically excludes merely a flexible string, such as a string wound or looped around a digit, such as the "flexible string 42" described in U.S. Pat. No. 4,658,446.

As noted, bending a finger, toe or wrist pulls or pushes a corresponding cable or other link, which causes a corresponding movable portion to move, thereby animating a corresponding articulated member. It should be noted that bending a wrist causes fingers of the corresponding hand to move generally along an arc, even if the human does not also explicitly bend the fingers, relative to the wrist. If one or more of the fingers are engaged by rings or other actuators coupled to Bowden cables or other links, bending the wrist, even without also explicitly bending the fingers relative to the wrist, may cause movement of the inner cables of Bowden cables or other links Thus, as used herein, an actuator that receives, contacts or is engaged by a digit, such as a ring worn on a finger, that moves in response to bending of a wrist or ankle associated with the digit is to be considered an actuator configured to move in response to movement of the received, contacted or engaged digit.

While the invention is described through the above-described exemplary embodiments, it will be understood by those of ordinary skill in the art that modifications to, and variations of, the illustrated embodiments may be made without departing from the inventive concepts disclosed herein. Disclosed aspects of the invention, or portions of these aspects, may be combined in ways not listed above. For example, finger or thumb operated actuators may be used to control articulated members attached to footwear, and toe operated actuators may be used to control articulated members attached to articles of apparel other than footwear. Accordingly, the invention should not be viewed as being limited to the disclosed embodiments.

What is claimed is:

1. A body-carried or body-worn, mechanically remotely-controlled novelty device, comprising:

an article of apparel defining an opening and configured to be removably attached to a portion of a human body, other than a hand, by receiving the portion of the human body within the opening;

an articulated member attached to the article of apparel and comprising a first portion and a second portion, the second portion being movable, relative to the first portion;

an actuator configured to receive a digit of an appendage of the human body and to move in response to movement of the received digit;

a link comprising a tube and a cable extending coaxially through the tube, the cable solely mechanically coupling the actuator to the articulated member, such that movement of the actuator, caused by movement of the received digit, causes movement of the second portion of the articulated member, relative to the first portion of the articulated member; and a strap defining an opening and configured to be removably attached to at least a portion of the appendage of the human body by receiving the at least a portion of the appendage within the opening, wherein at least a portion of the tube is attached to the strap, such that the attached at least a portion of the tube does not substantially translate along its length, relative to the strap.

2. A novelty device according to claim 1, wherein the actuator defines a shape-retaining portion configured to receive the digit of the human body.

3. A novelty device according to claim 1, wherein the actuator comprises a ring sized to receive a human digit.

4. A novelty device according to claim 1, wherein the actuator comprises a lever sized to receive a human digit.

5. A novelty device according to claim 1, wherein the actuator comprises:

a housing sized and configured to fit within a palm of the human body;

a spring-loaded plunger extending from the housing, an end of the plunger being configured to receive the digit, the plunger being mechanically coupled to the link such that movement of the plunger causes the movement of the link.

6. A novelty device according to claim 1, wherein the strap comprises at least one of: a wrist strap, and a bracelet.

7. A novelty device according to claim 1, wherein the link further comprises a lever, the cable being attached to one end of the lever, the other end of the lever being rigidly attached to the second portion of the articulated member, such that the translation of the cable causes movement of the lever, and the movement of the lever causes the movement of the second portion of the articulated member through a mechanical advantage provided by the lever.

8. A novelty device according to claim 1, wherein the articulated member has an external shape, at least a portion of the external shape representing a shape of at least one of: an anatomical feature, a body part, an ear, an antenna, an antler, a horn, a tail, a mouth, a lip, a nose, an elephant trunk, an eye, an eyelid, a toe, a heart, a head, an arm, a leg, a wing, a hat, an elongated tapered portion, a narrow end of which terminates in a closed end, a whimsical shape and at least a portion of a cartoon character.

9. A novelty device according to claim 1, wherein the article of apparel comprises at least one of: a headband, a belt, a shoulder strap, a cap, an article of footwear, a shirt, a backpack, pants and a shirt having a hood.

10. A novelty device according to claim 1, wherein the articulated member further comprises a hinge coupled between the first portion and the second portion of the articulated member.

11. A novelty device according to claim 1, wherein the articulated member further comprises a resilient portion coupled between the first portion and the second portion of the articulated member and configured to urge the second portion toward a predetermined orientation, relative to the first portion.

12. A novelty device according to claim 1, wherein the articulated member further comprises a pivot coupled between the first portion and the second portion of the articulated member and configured to permit the second portion to rotate, relative to the first portion, at least about 10 degrees about the pivot.

13. A novelty device according to claim 1, wherein the articulated member further comprises a movable coupling between the first portion and the second portion of the articulated member, thereby separating the first portion from the second portion of the articulated member, wherein the movable coupling is more flexible than portions of the articulated member adjacent the movable coupling.

14. A novelty device according to claim 13, wherein the movable coupling comprises a spring.

15. A novelty device according to claim 13, wherein the movable coupling comprises a resilient plastic foam.

16. A novelty device according to claim 13, wherein the movable coupling comprises a portion of the articulated member that is thinner and more flexible than portions of the articulated member adjacent the movable coupling.

17. A novelty device according to claim 1, further comprising:

a second articulated member attached to the article of apparel and comprising a first portion and a second portion, the second portion being movable, relative to the first portion;

a second actuator configured to receive a second digit of the appendage of the human body and to move in response to movement of the received digit; and a second link comprising a second tube and a second cable extending coaxially through the second tube, the second cable solely mechanically coupling the second actuator to the second articulated member, such that movement of the second actuator, caused by movement of the received second digit, causes movement of the second portion of the second articulated member, relative to the first portion of the second articulated member, wherein at least a portion of the second tube is attached to the strap, such that the attached at least a portion of the second tube does not substantially translate along its length, relative to the strap.

18. A novelty device according to claim 1, wherein:

the articulated member further comprises a third portion, the third portion being movable relative to the second portion; the novelty device further comprising:

a second actuator configured to receive a digit of the appendage of the human body and to move in response to movement of the received digit; and a second link comprising a second tube and a second cable extending coaxially through the second tube, the second cable solely mechanically coupling the second actuator to the articulated member, such that movement of the second actuator, caused by movement of the digit received by the second actuator, causes movement of the third portion of the articulated member, relative to the second portion of the articulated member, wherein at least a portion of the second tube is attached to the strap, such that the attached at least a portion of the second tube does not substantially translate along its length, relative to the strap.

19. A method for making a body-carried or worn, mechanically remotely-controlled novelty device, the method comprising:

providing a novelty device having at least one moveable portion;

providing an actuator configured to receive a digit of an appendage of a human body and to move in response to movement of the received digit;

mechanically coupling, via a solely mechanical link comprising a tube and a cable extending coaxially through the tube, the actuator to the at least one moveable portion of the novelty device, such that movement of the actuator, caused by movement of the received digit, causes movement of the at least one movable portion of the novelty device;

attaching the tube to a strap that defines an opening and configured to be removably attached to at least a portion of the appendage of the human body by receiving the at least a portion of the appendage within the opening, wherein at least a portion of the tube is attached to the strap, such that the attached at least a portion of the tube does not substantially translate along its length, relative to the strap; and attaching the novelty device to an article of apparel defining an opening and configured to be removably attached to a portion of the human body, other than a hand, by receiving the portion of the human body within the opening.

20. A method for animating a body-carried or worn, mechanically remotely-controlled novelty device having at least one moveable portion, an article of apparel defining an opening, an actuator configured to receive a digit of an appendage of a human body and to move in response to movement of the received digit and a link comprising a tube and a cable extending coaxially through the tube, the cable solely mechanically coupling the actuator to the movable portion of the novelty device, such that movement of the actuator, caused by movement of the received digit, causes movement of the movable portion of the novelty device, the tube being attached to a strap defining an opening and configured to be removably attached to at least a portion of the appendage of the human body by receiving the at least a portion of the appendage within the opening, wherein at least a portion of the tube is attached to the strap, such that the attached at least a portion of the tube does not substantially translate along its length, relative to the strap, the method comprising:

removably attaching the article of apparel to a portion of a human body, other than a hand, by receiving the portion of the human body within the opening;

attaching the strap to the appendage of the human body;

receiving a digit of the human body with the actuator; and actuating the actuator by the received digit.

* * * * *